US007775510B2

(12) United States Patent
Yamamura et al.

(10) Patent No.: US 7,775,510 B2
(45) Date of Patent: Aug. 17, 2010

(54) SHEET PROCESSING DEVICE AND IMAGE FORMING APPARATUS

(75) Inventors: Mitsuru Yamamura, Saitama-ken (JP); Toshiaki Tobishima, Saitama-ken (JP); Satoshi Otomo, Saitama-ken (JP)

(73) Assignee: Ricoh Company, Ltd., Tokyo (JP)

( * ) Notice: Subject to any disclaimer, the term of this patent is extended or adjusted under 35 U.S.C. 154(b) by 295 days.

(21) Appl. No.: 12/007,515

(22) Filed: Jan. 11, 2008

(65) Prior Publication Data

US 2008/0185762 A1 Aug. 7, 2008

(30) Foreign Application Priority Data

Jan. 12, 2007 (JP) ..... 2007-004955
Nov. 1, 2007 (JP) ..... 2007-285194

(51) Int. Cl.
*B31F 1/10* (2006.01)

(52) U.S. Cl. ..... 270/39.01; 270/39.06; 270/45; 270/58.07

(58) Field of Classification Search ..... 270/20.1, 270/39.01, 39.06, 45, 58.07; 493/356, 424, 493/429, 434
See application file for complete search history.

(56) References Cited

U.S. PATENT DOCUMENTS 5,951,000 A * 9/1999 Sato et al. ..... 270/58.11
6,719,283 B2 * 4/2004 Tsuchiya et al. ..... 270/58.07
6,719,680 B2 * 4/2004 Hosoya et al. ..... 493/324
7,052,005 B2 * 5/2006 Yamakawa et al. ..... 270/37
7,503,886 B2 * 3/2009 Sekine et al. ..... 493/434
2006/0205580 A1 9/2006 Sekine et al.
2007/0219080 A1 9/2007 Otomo et al.
2008/0174061 A1 * 7/2008 Kurita ..... 270/45

FOREIGN PATENT DOCUMENTS

| | | |
|---|---|---|
| JP | 04-333462 | 11/1992 |
| JP | 05-008902 | 1/1993 |
| JP | 05-027530 | 2/1993 |
| JP | 3173095 | 3/2001 |
| JP | 2006-290618 | 10/2006 |
| JP | 2006-290623 | 10/2006 |

* cited by examiner

*Primary Examiner*—Gene Crawford
*Assistant Examiner*—Leslie A Nicholson, III
(74) *Attorney, Agent, or Firm*—Harness, Dickey & Pierce, P.L.C.

(57) ABSTRACT

A sheet processing device includes a folding unit, a punch unit, and a cross folding unit. The folding unit folds a sheet conveyed to the sheet processing device a plurality of times. The punch unit punches a hole in a predetermined portion of the folded sheet. The cross folding unit cross-folds the punched sheet on a vertically-extending conveying path.

16 Claims, 35 Drawing Sheets

FIG. 25AA
FIG.25A
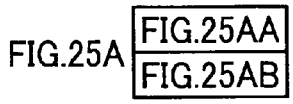
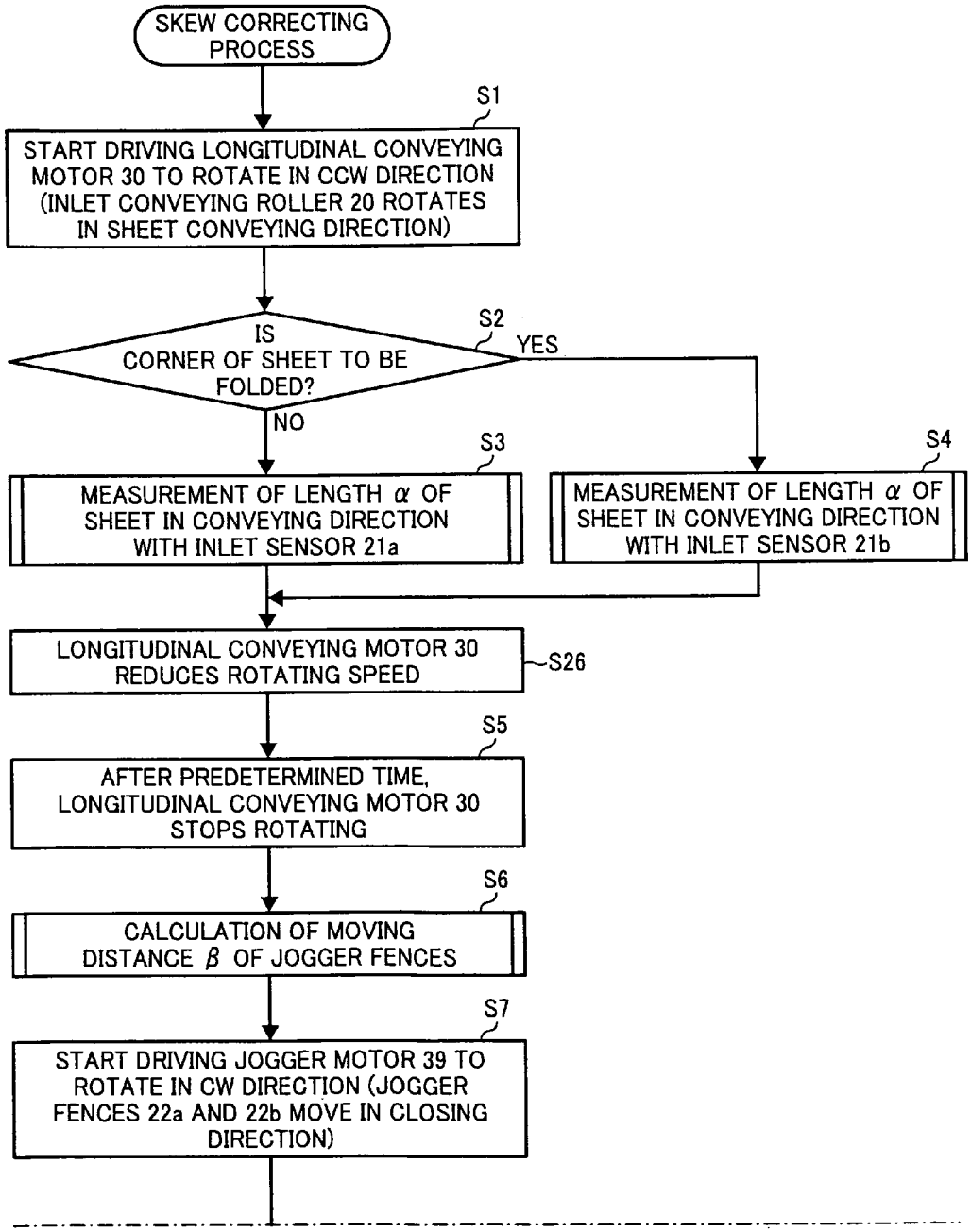

SHEET PROCESSING DEVICE AND IMAGE FORMING APPARATUS

CROSS-REFERENCE TO RELATED APPLICATIONS

The present application claims priority to and incorporates by reference the entire contents of Japanese priority documents 2007-004955 filed in Japan on Jan. 12, 2007 and 2007-285194 filed in Japan on Nov. 1, 2007.

BACKGROUND OF THE INVENTION

1. Field of the Invention

The present invention relates to a sheet processing device capable of folding a large-size sheet into a small-size folded sheet and punching the folded sheet, and an image forming apparatus including the sheet processing device.

2. Description of the Related Art

When a copy of a large-sized original document such as a drawing is made by a copier, the document is copied onto a large-sized sheet such as an A0-size sheet or an A1-size sheet in most cases. The large-sized sheet is usually folded into a small size to store the sheet in a convenient manner for saving storage space. However, if the sheet is manually folded, it takes a considerable time to fold the sheet. In some cases, it may take a longer time to fold the sheet manually than that to make a copy. Therefore, a sheet folding device capable of folding, for example, the A0-size sheet into an A4 size, is provided on a sheet discharging path of the copier.

In general, such a sheet folding device is mounted on an image forming apparatus such as a copier or a facsimile machine, and arranged in the downstream side of a sheet conveying direction. The sheet folding device includes a folding mechanism for folding a sheet with a predetermined method. The folding mechanism includes, for example, a punching unit that punches a hole in the folded sheet to bind the folded sheet.

A typical sheet folding device is disclosed in Japanese Patent No. 3173095. In the sheet folding device, a fold-data storing unit stores therein fold data. A folding unit folds a sheet based on the fold data stored in the fold-data storing unit. A sheet-running state detecting unit detects a running state of the sheet in the folding unit. A correction-data calculating unit obtains correction data based on a result of detection by the sheet-running state detecting unit. A fold-data correcting unit corrects the fold data stored in the fold-data storing unit based on the correction data obtained by the correction-data calculating unit. A fold-data updating unit updates the fold data stored in the fold-data storing unit.

However, a conventional sheet folding device including the one disclosed in Japanese Patent No. 3173095 requires a relatively large space for installing the sheet folding device because the sheet folding device is bulky due to including a folding mechanism that includes a punching unit. In addition, it is necessary to ensure extra space for a maintenance work, for example, for fixing a paper jam.

SUMMARY OF THE INVENTION

It is an object of the present invention to at least partially solve the problems in the conventional technology.

According to an aspect of the present invention, there is provided a sheet processing device that folds a sheet a plurality of times and outputs a folded sheet. The sheet processing device includes a cross folding unit that cross-folds the folded sheet that is folded a plurality of times at preceding stages.

The cross folding unit cross-folds the folded sheet on a second sheet conveying path that is perpendicular to a first conveying path for processes of precedent stages.

Furthermore, according to another aspect of the present invention, there is provided an image forming apparatus including a sheet processing device that folds a sheet a plurality of times and outputs a folded sheet. The sheet processing device includes a cross folding unit that cross-folds the folded sheet that is folded a plurality of times at preceding stages. The cross folding unit cross-folds the folded sheet on a second sheet conveying path that is perpendicular to a first conveying path for processes of precedent stages.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are explained in detail below with reference to the accompanying drawings.

Figure 1:
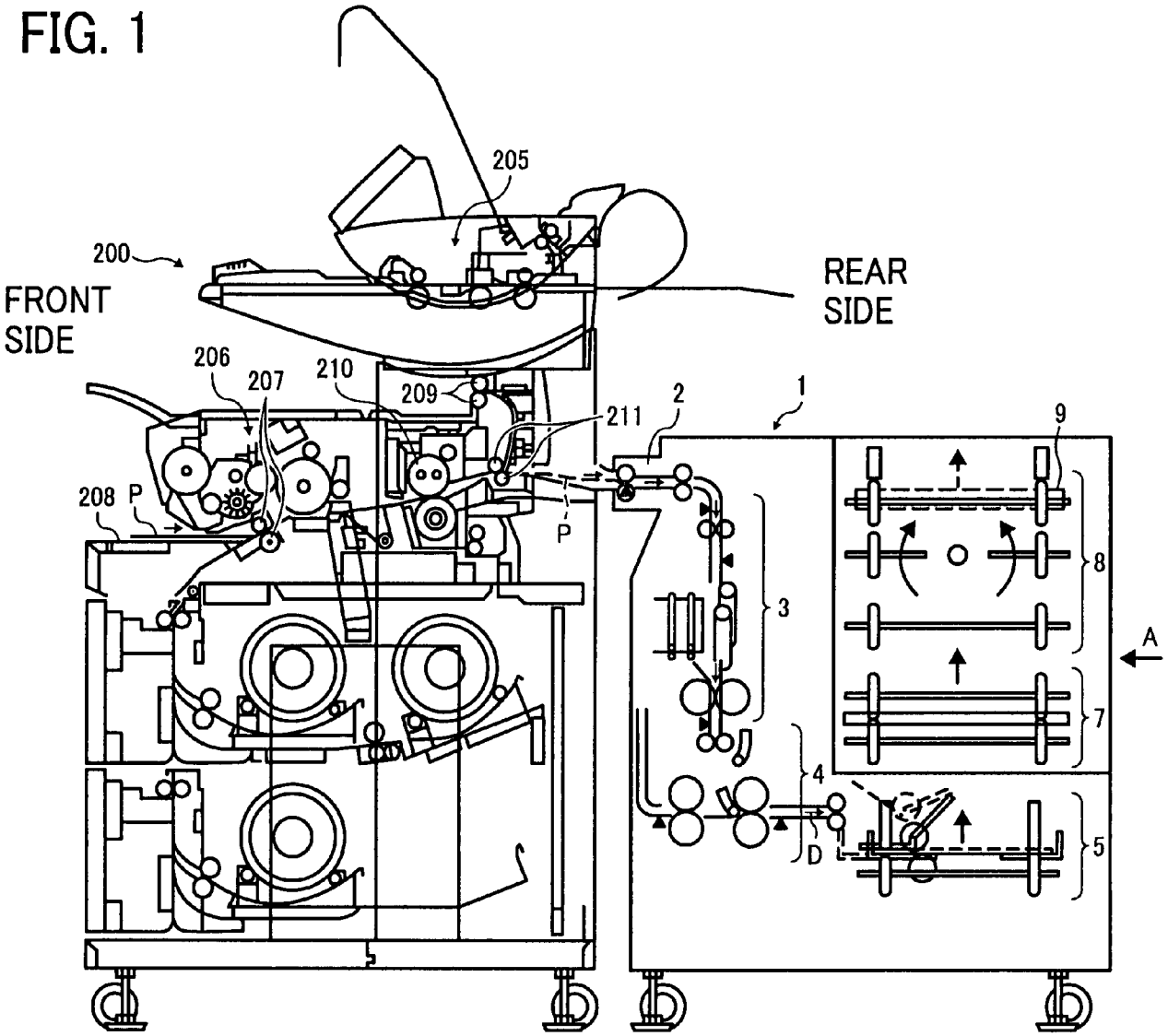
FIG. 1 is a side view of a copying machine and a sheet folding device according to an embodiment of the present invention.
Figure 2:
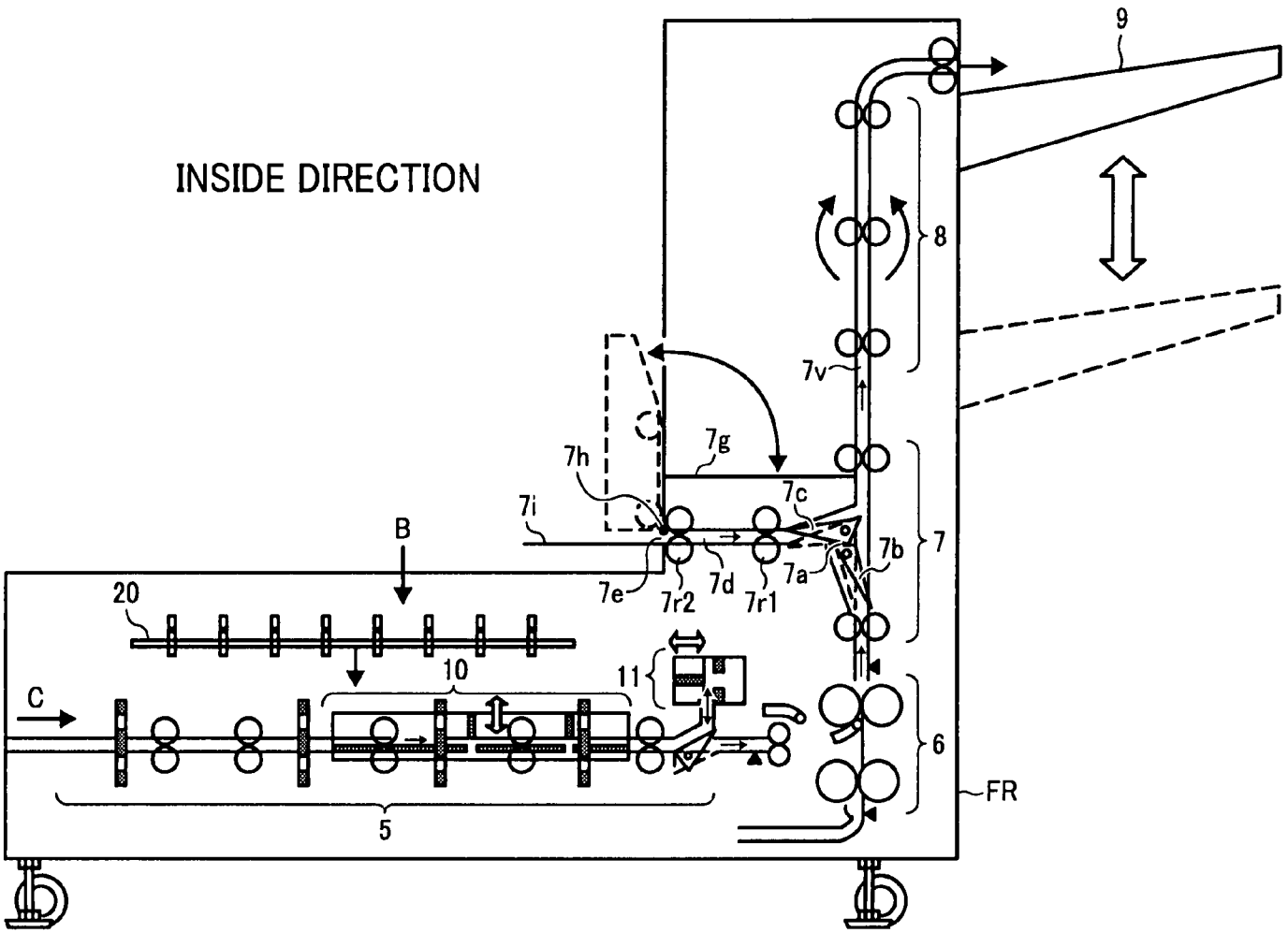
FIG. 2 is a side view of a sheet processing unit included in the sheet folding device shown in FIG. 1.
Figure 9:
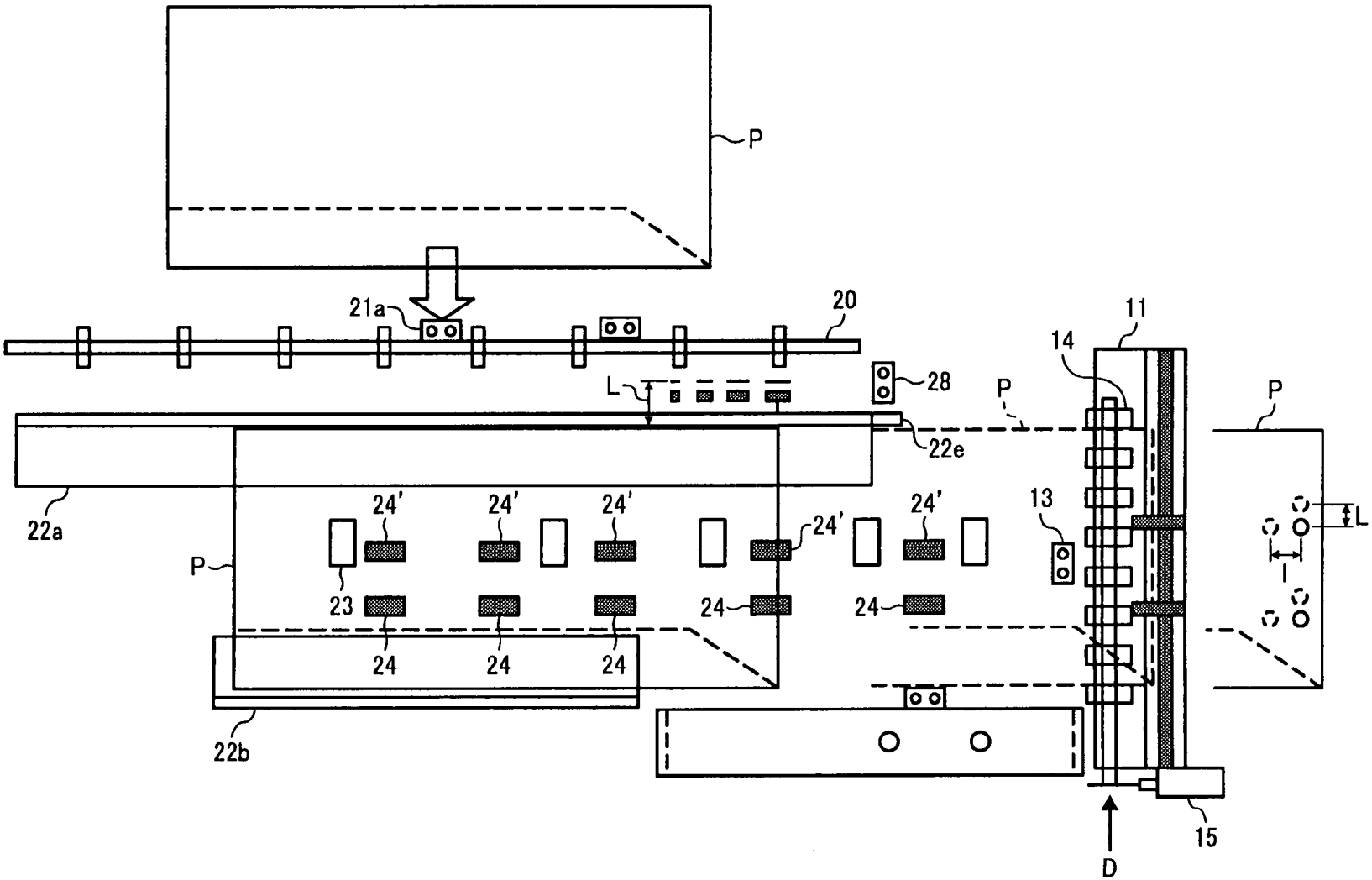
FIG. 9 is a plan view of the sheet processing unit for explaining a process of punching a longitudinal hole in an A2-size landscape sheet.
Figure 10:
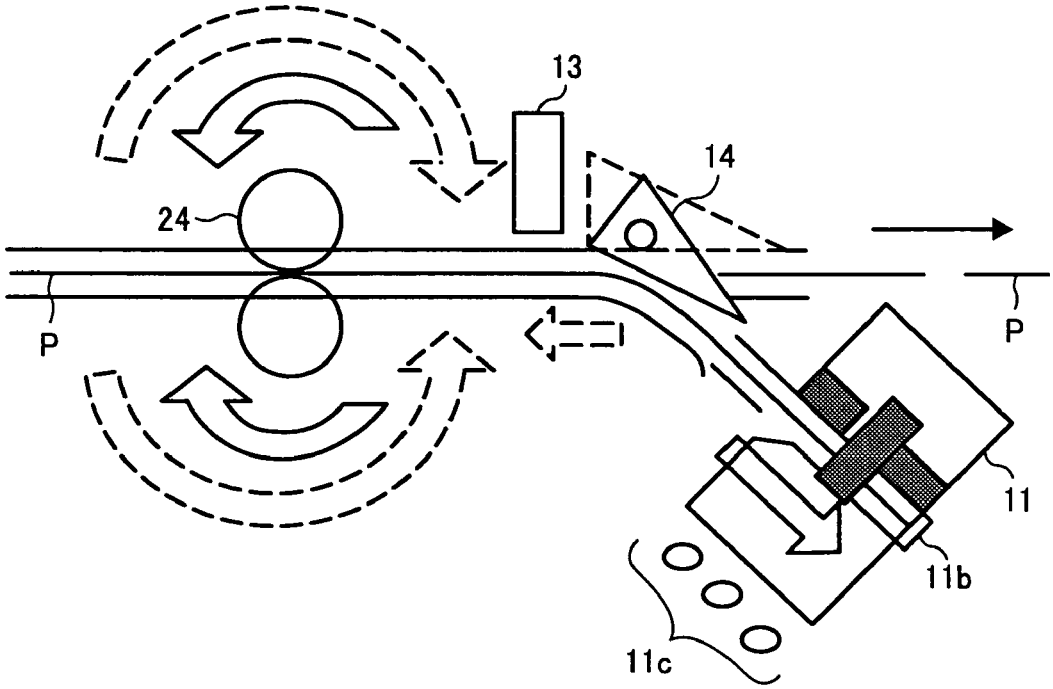
FIG. 10 is a side view of main units of the sheet processing unit shown in FIG. 9.
Figure 11:
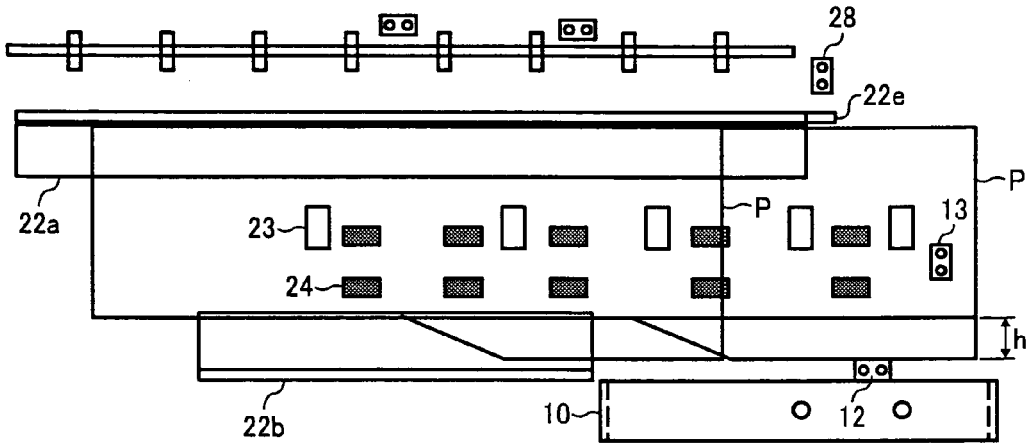
FIG. 11 is a plan view of the sheet processing unit for explaining an aligning step included in a process of punching a lateral hole in an A1-size portrait sheet.
Figure 12:
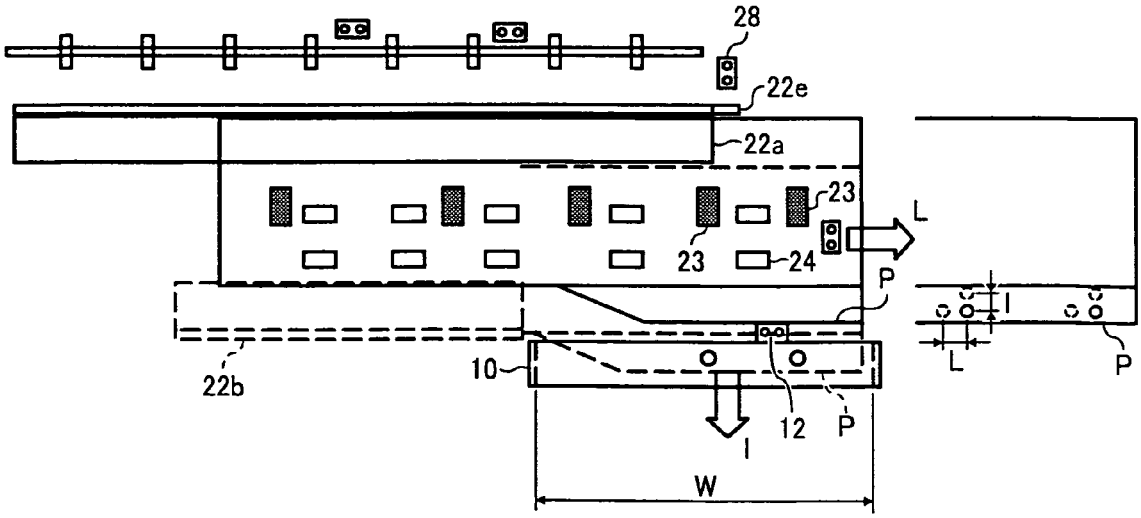
FIG. 12 is a plan view of the sheet processing unit for explaining a discharging step included in the process of punching a lateral hole in the A1-size portrait sheet.
Figure 13:
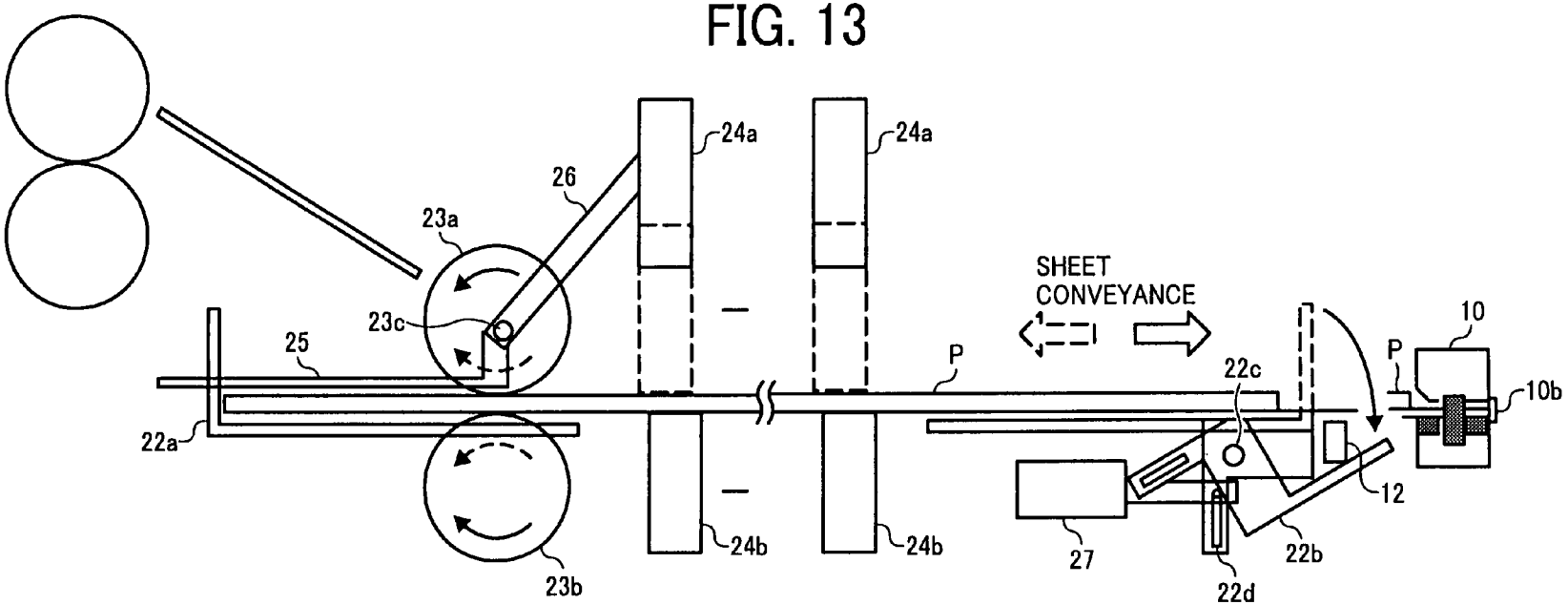
FIG. 13 is a side view of the sheet processing unit for explaining the process of punching a lateral hole in the A1-size portrait sheet.
Figure 14:
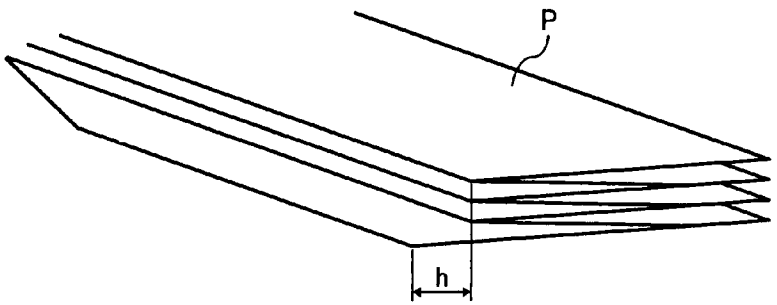
FIG. 14 is a perspective view of the A1-size portrait sheet for explaining how the A1-size portrait sheet is folded.
Figure 15:
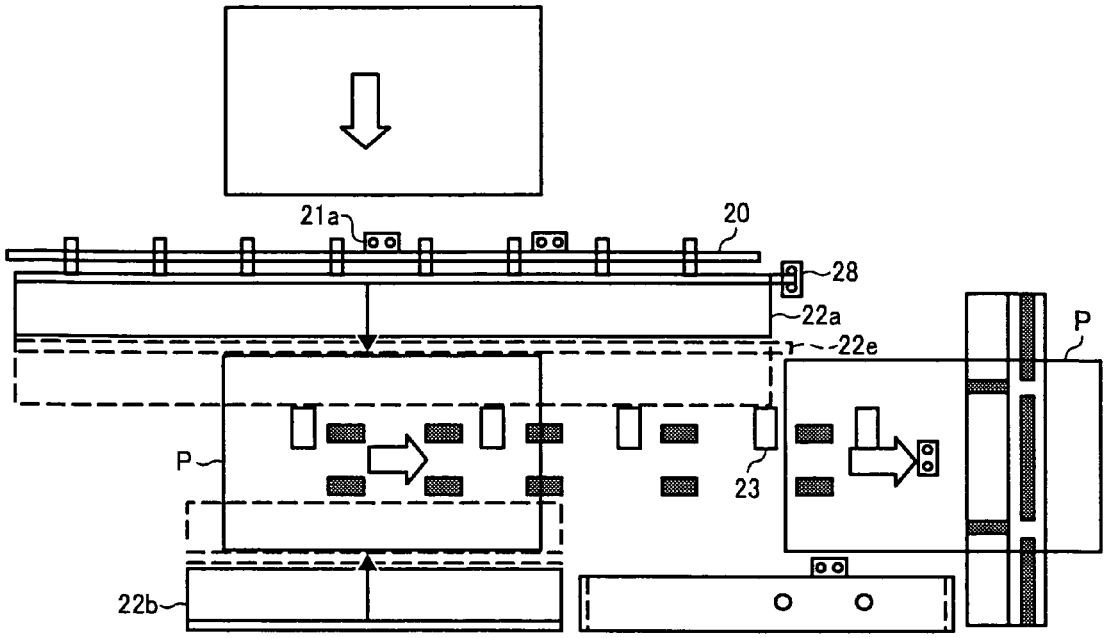
FIG. 15 is a plan view of the sheet processing unit for explaining a process of correcting a skew of an A4-size landscape sheet performed by a conveyance switching unit.
Figure 16:
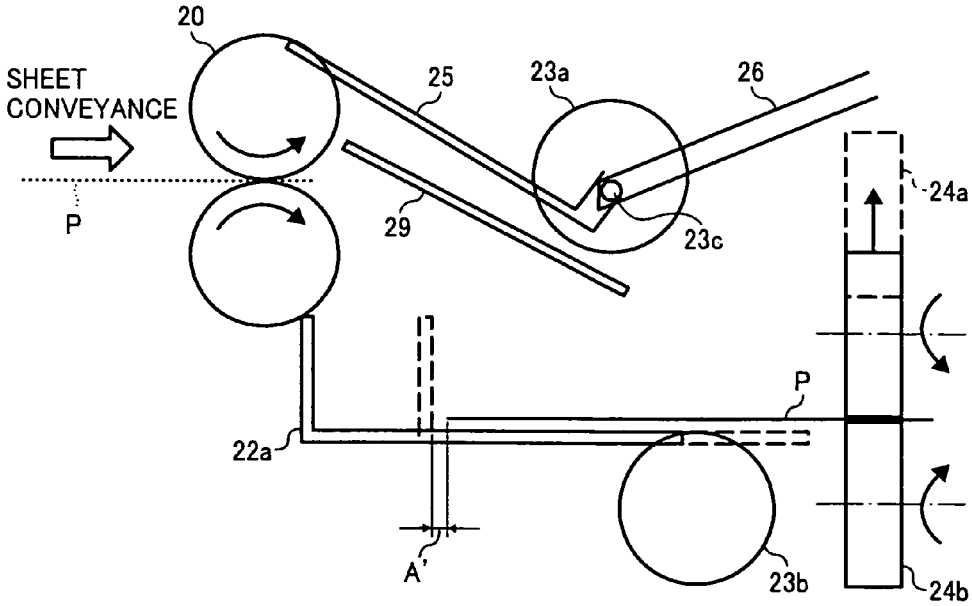
FIG. 16 is a side view of the sheet processing unit shown in FIG. 15.
Figure 17:
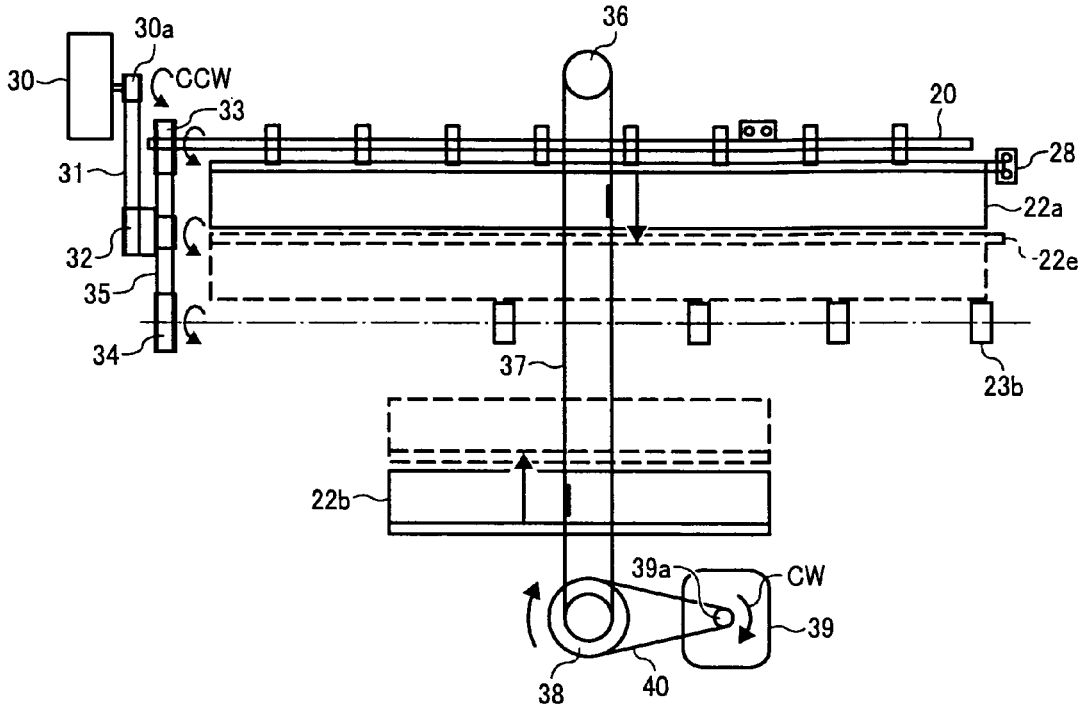
FIG. 17 is a plan view of a jogger-fence driving mechanism, an inlet conveying roller, and return rollers.
Figure 18:
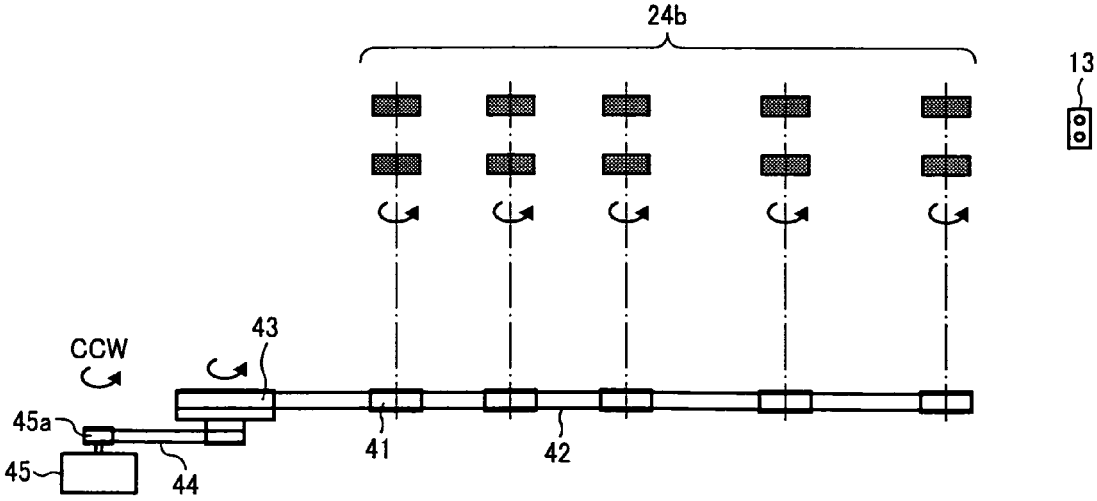
FIG. 18 is a schematic diagram of a configuration for driving lateral conveying rollers to rotate.
Figure 19:
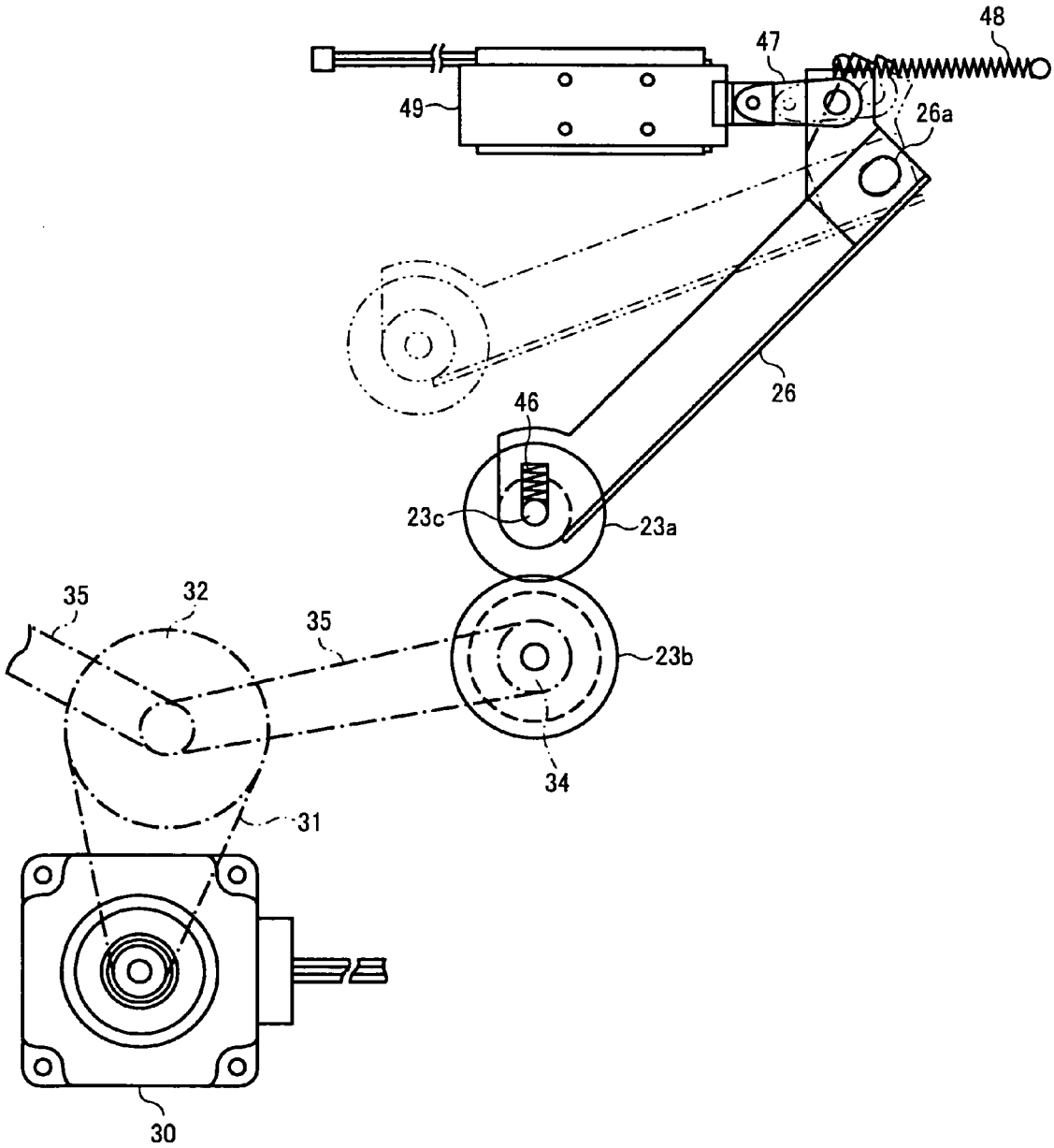
FIG. 19 is a schematic diagram of a mechanism for swinging the return rollers.
Figure 20:
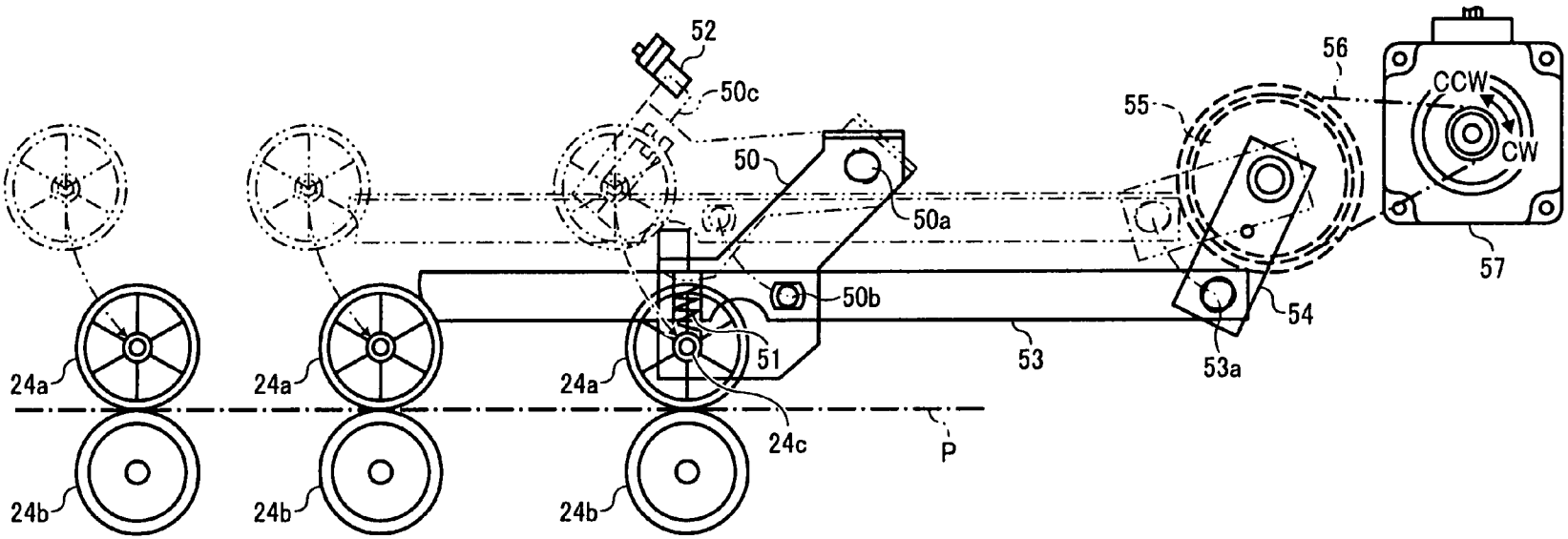
FIG. 20 is a schematic diagram of a mechanism for swinging the lateral conveying rollers with the application of pressure.
Figure 21:
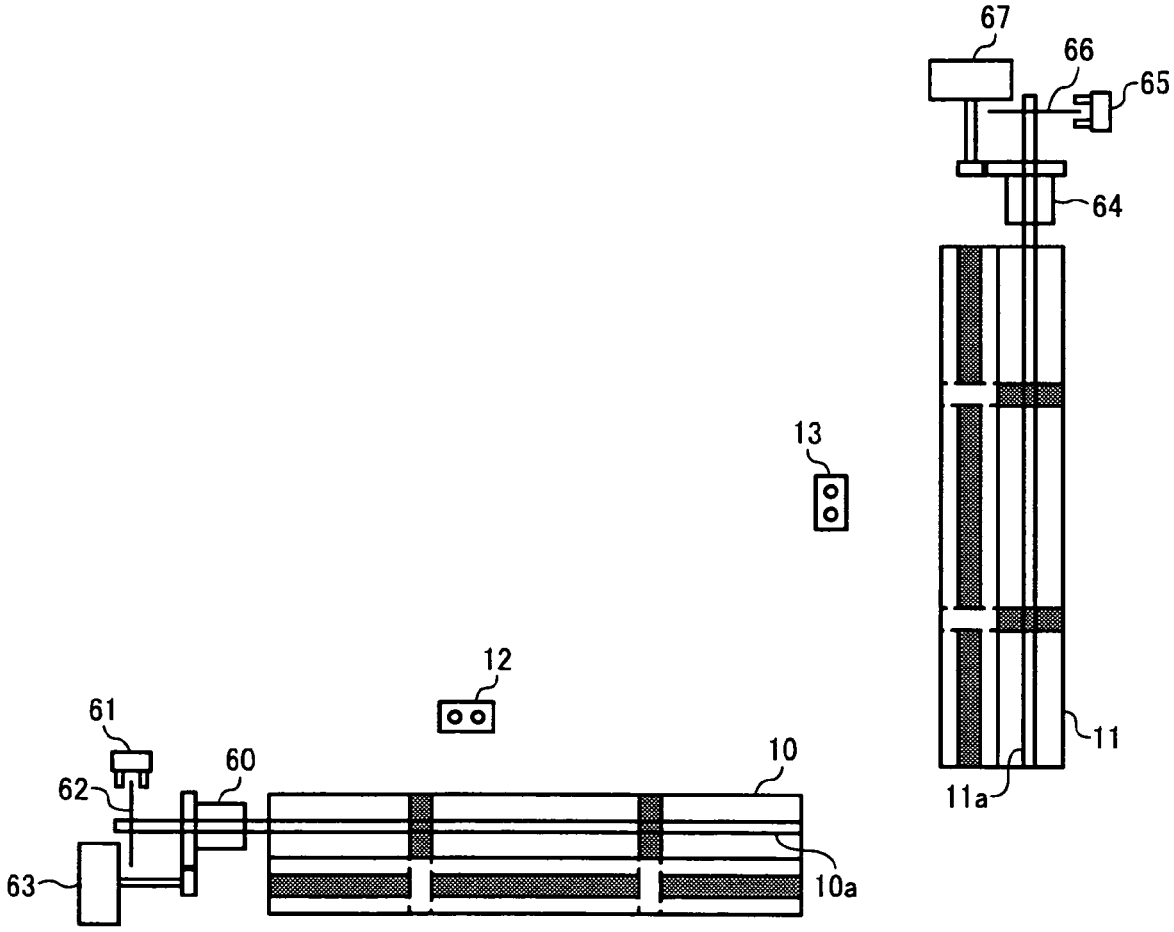
FIG. 21 is a schematic diagram of a punching mechanism.
Figure 22:
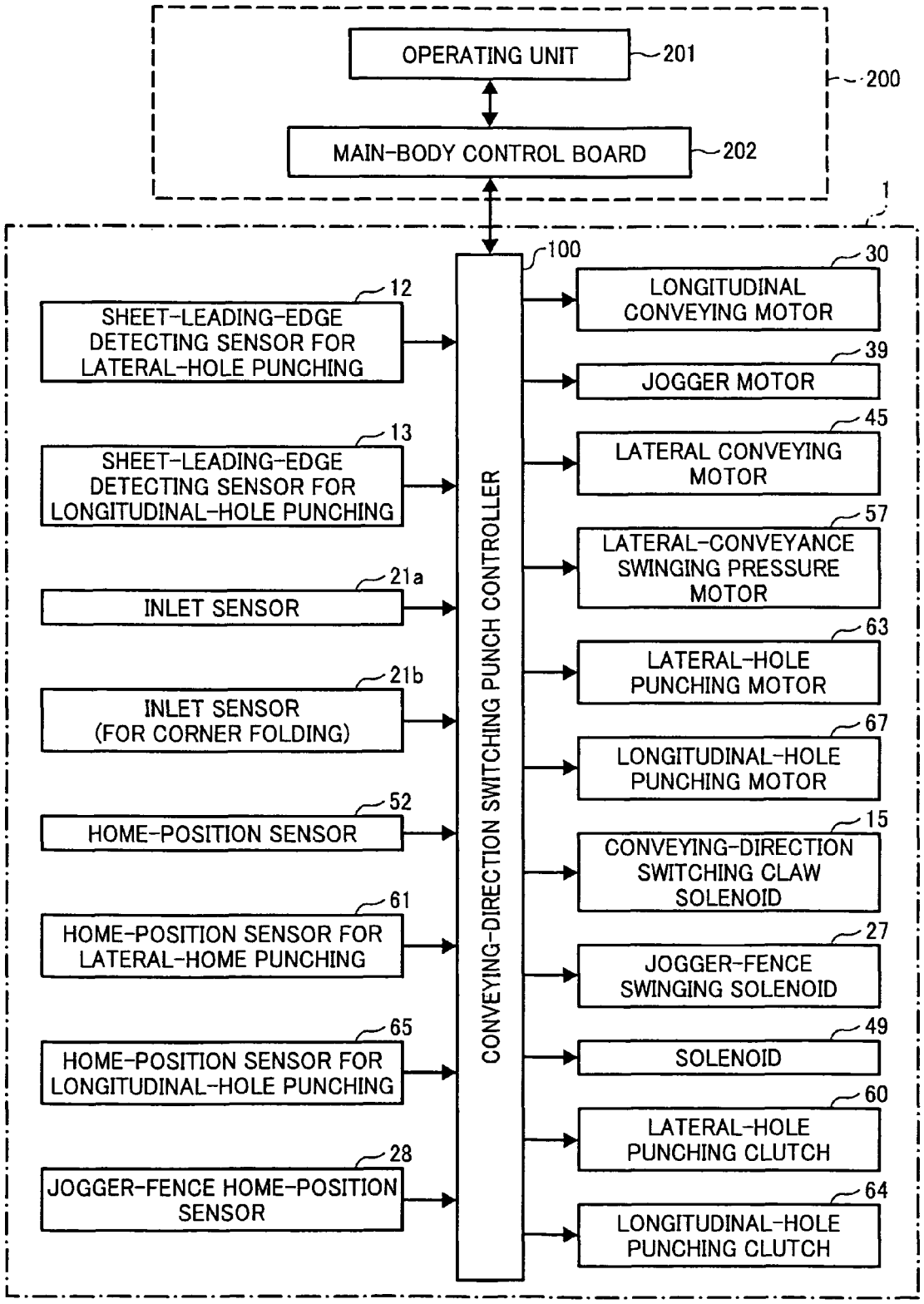
FIG. 22 is a block diagram of an electric-control system configuration.

FIG. 1 is a side view of a whole system including a copying machine and a sheet folding device 1 according to an embodiment of the present invention. FIG. 2 is a side view of a sheet post-processing device FR included in the sheet folding device 1 (viewed from a rear side of the sheet post-processing device FR shown in FIG. 1). FIGS. 3 to 8 are plan views and side views of a conveyance switching unit 5 included in the sheet post-processing device FR for explaining a process of correcting a skew of an A1-size portrait sheet. FIGS. 9 and 10 are schematic diagrams of the conveyance switching unit 5 for explaining a process of punching a longitudinal hole in an A2-size landscape sheet. FIGS. 11 to 13 are schematic diagrams of the conveyance switching unit 5 for explaining a process of punching a lateral hole in an A1-size portrait sheet. FIG. 14 is a perspective view of the A1-size portrait sheet for explaining how the A1-size portrait sheet is folded. FIGS. 15 and 16 are respectively a plan view and a side view of the conveyance switching unit 5 for explaining a process of correcting a skew of an A4-size landscape sheet. FIG. 17 is a plan view of a jogger-fence driving mechanism, an inlet conveying roller, and return rollers. FIG. 18 is a schematic diagram of a configuration for driving lateral conveying rollers to rotate. FIG. 19 is a schematic diagram of a mechanism for swinging the return rollers. FIG. 20 is a schematic diagram of a mechanism for swinging the lateral conveying rollers with the application of pressure. FIG. 21 is a schematic diagram of a punching mechanism. FIG. 22 is a block diagram of an electric-control system configuration according to the embodiment. FIGS. 25A to 32 are flowcharts for explaining processing procedures of each of processes.

The sheet folding device 1 is connected to a rear side of a main body 200 of the copying machine. The sheet folding device 1 folds a corner of a sheet, and accordion-folds the sheet. The sheet folding device 1 includes a connecting unit 2, a corner folding unit 3, an accordion-folding unit 4, the conveyance switching unit 5, a cross-folding unit 6, a reversing unit 7, a turning unit 8, and a tray 9. The connecting unit 2 connects the sheet folding device 1 to the main body 200. The corner folding unit 3 folds a corner of a sheet. The accordion-folding unit 4 accordion-folds a sheet in a conveying direction. The conveyance switching unit 5 switches the conveying direction of the sheet by 90 degrees. The reversing unit 7 reverses a sheet. The turning unit 8 turns a sheet 90 degrees, for example, turns an A4-size sheet from a landscape orientation to a portrait orientation. A folded sheet is discharged and stacked onto the tray 9.

The main body 200 of the copying machine includes an image reading unit 205, a manual sheet feeding tray 208, a registration roller 207, an image forming unit 206, a fixing unit 210, a sheet discharging roller 211, and an upper sheet discharging roller 209. The manual sheet feeding tray 208 is arranged below the image reading unit 205. When a sheet is set on the manual sheet feeding tray 208, the sheet is fed into the main body 200, and paused by the registration roller 207, and then fed to the image forming unit 206 at a predetermined timing. The image forming unit 206 forms a latent image corresponding to image data on a photosensitive element (not shown). The latent image is developed into a toner image with a toner, and the toner image is transferred onto the sheet. When the sheet onto which the toner image is transferred is fed to the fixing unit 210, the image on the sheet is fixed thereon by the fixing unit 210. If the sheet is to be folded, the sheet is discharged to the sheet folding device 1 by the sheet discharging roller 211. On the other hand, if the sheet is not to be folded, the sheet is fed into the middle part of the main body 200 by the upper sheet discharging roller 209. A sheet feeding direction is switched by a switching claw (not shown). Incidentally, if a jam occurs in the sheet post-processing device FR, a location where the jam occurs is displayed on a display unit (not shown) of the copying machine.

When the sheet is to be folded, the sheet is conveyed to the sheet folding device 1 by the sheet discharging roller 211. A corner of the sheet is folded by the corner folding unit 3. While the corner of the sheet is folded, the sheet is kept being conveyed. After that, the sheet is accordion-folded by the accordion-folding unit 4, and the accordion-folded sheet is conveyed to the conveyance switching unit 5. A skew of the accordion-folded sheet is corrected in the sheet post-processing device FR shown in FIG. 2, which is viewed from a direction of an arrow A shown in FIG. 1. The accordion-folded sheet is punched as needed, and conveyed to the cross-folding unit 6. The cross-folding unit 6 accordion-folds the received accordion-folded sheet in a direction perpendicular to the previously accordion-folded direction (hereinafter, "cross-folds") so as to fold the sheet into an A4 size. The A4-sized accordion-folded sheet is conveyed to the reversing unit 7 in a vertical direction. The reversing unit 7 reverses the A4-sized accordion-folded depending on a folding pattern so that an image-formed surface of the sheet faces down when the sheet is discharged onto the tray 9, and conveyed into a conveying path.

As shown in FIG. 1, the sheet post-processing device FR shown in FIG. 2 is arranged in the upstream side of the sheet folding device 1. An accordion-folded sheet on which an image is formed is sequentially conveyed to the sheet post-processing device FR in a direction of an arrow B (in FIG. 1, in a direction of an arrow D). The accordion-folded sheet is conveyed into the conveyance switching unit 5 by an inlet conveying roller 20. The conveyance switching unit 5 turns the accordion-folded sheet 90 degrees, and conveys the turned sheet in a direction of an arrow C.

Figure 3:
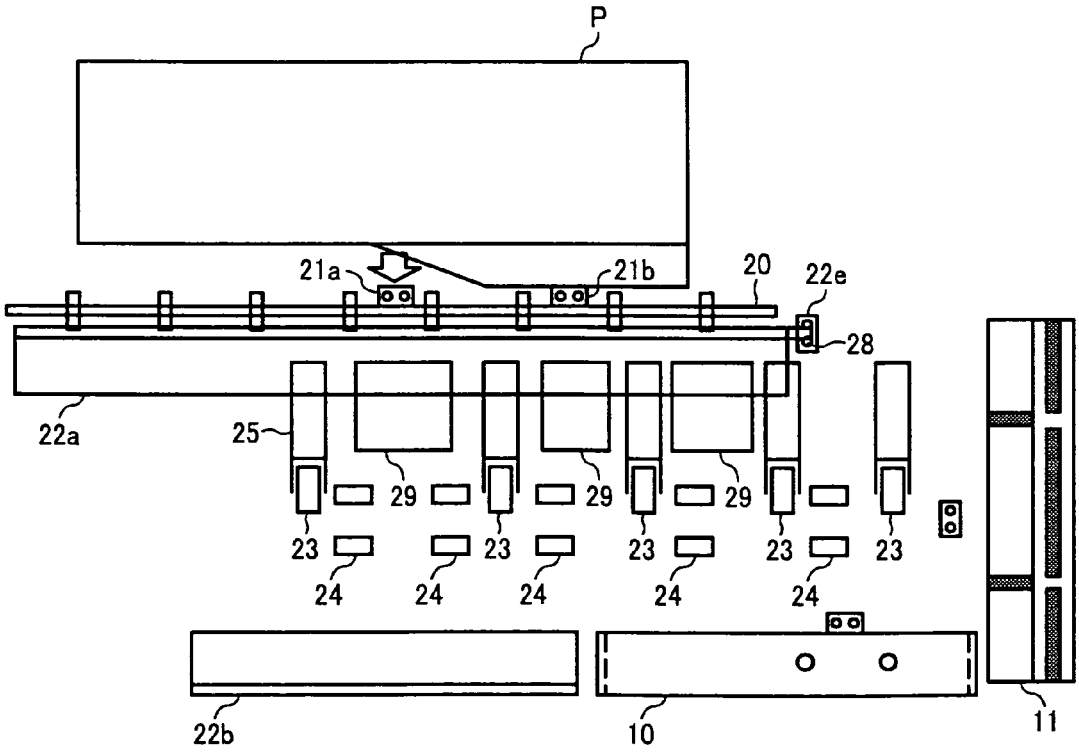
FIG. 3 is a plan view of the sheet processing unit for explaining a process of correcting a skew of an A1-size portrait sheet.

As shown in FIG. 3, inlet sensors 21*a* and 21*b* are arranged in the upstream side of the inlet conveying roller 20. The inlet sensors 21*a* and 21*b* are aligned in parallel to each other. The inlet sensor 21*a* detects a leading edge of a sheet P in a side of which a corner of the sheet P is not folded. The inlet sensor 21*b* detects the leading edge of the sheet P in the other side of which the corner of the sheet is folded. In a case shown in FIG. 3, a bottom-left corner of the sheet P is folded.

Figure 4:
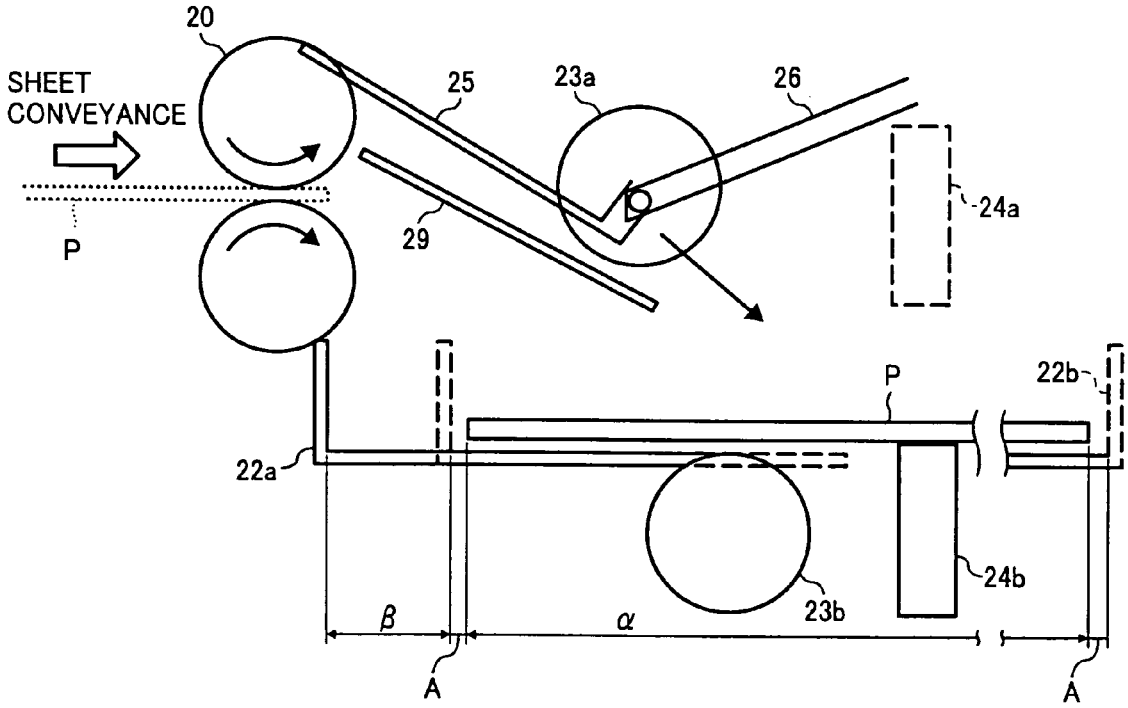
FIG. 4 is a side view of the sheet processing unit shown in FIG. 3.
Figure 5:
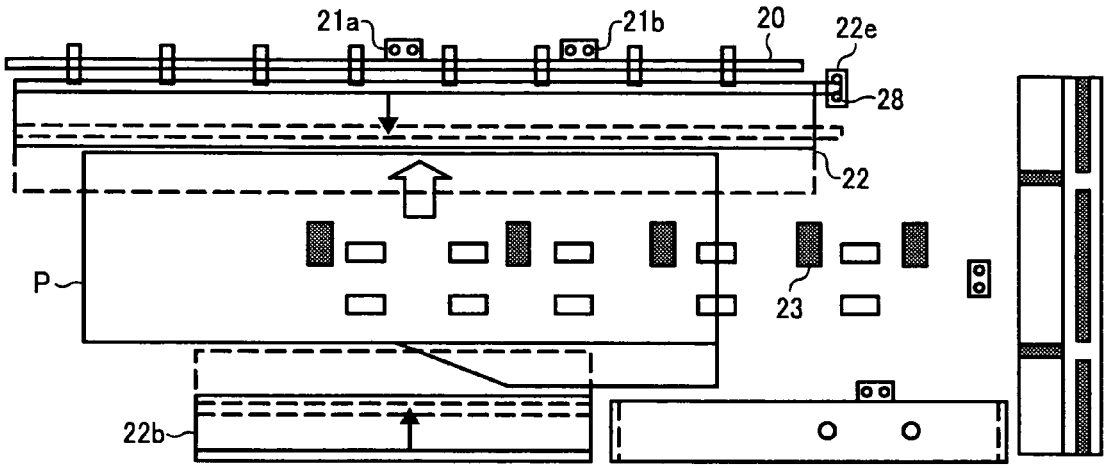
FIG. 5 is a plan view of the sheet processing unit for explaining a state in which the sheet processing unit performs the process of correcting the skew of the A1-size portrait sheet.

The conveyance switching unit 5 includes jogger fences 22*a* and 22*b*, a plurality of return rollers 23, a plurality of lateral conveying rollers 24, a lateral-hole punching unit 10, and a longitudinal-hole punching unit 11. Each of the jogger fences 22*a* and 22*b* moves forward or backward with respect to an incoming direction of the sheet P conveyed from the inlet conveying roller 20 so as to adjust the sheet P to be positioned in the conveying direction. When the conveying direction of the sheet P is to be changed, the conveying direction of the sheet P is adjusted in a direction perpendicular to the conveying direction by movements of the jogger fences 22*a* and 22*b*. In the sheet folding device 1, the sheet P is discharged from the inlet conveying roller 20, so that a drop position of the sheet P is not constant, and thus a skew of the sheet with respect to the conveying direction is caused. Therefore, as shown in FIGS. 3 and 4, the conveying direction of the sheet discharged from the inlet conveying roller 20 is adjusted by the jogger fence 22*a*.

FIG. 19 is a schematic diagram for explaining a drive mechanism of the return rollers 23. The drive mechanism of the return rollers 23 includes a rotation drive unit and a swinging drive unit. A drive return roller 23*b* is arranged on the reverse side of the sheet, and a driven return roller 23*a* is arranged on the front side of the sheet. The drive return roller 23*b* is driven to rotate, and the driven return roller 23*a* rotates by a rotation transmission from the drive return roller 23*b* in accordance with a rotation of the drive return roller 23*b*. The drive return roller 23*b* and the driven return roller 23*a* cause the sheet to move back in pairs. A drive force from a longitudinal conveying motor 30 is transmitted to the drive return roller 23*b* via a drive belt 31, a pulley 32, a drive belt 35, and a pulley 34. By the drive force, the drive return roller 23*b* is driven to rotate in a direction of which the sheet moves back.

The driven return roller 23*a* is rotatably supported by a longitudinal conveying arm 26 in such a manner that the driven return roller 23*a* is pressed to an axis 23*c* of an end (a free end) of the longitudinal conveying arm 26 by the application of pressure of a pressure spring 46. The other end of the longitudinal conveying arm 26 is supported by a supporting point 26*a*, and connected to a drive shaft of a solenoid 49 via a joint. The drive shaft is elastically biased in a direction of which the driven return roller 23*a* moves away from the drive return roller 23*b* by a return spring 48 constantly. In other words, only when a current from the solenoid 49 is applied to the longitudinal conveying arm 26, the driven return roller 23*a* has contact with the drive return roller 23*b* directly or indirectly, and thus the drive force of the drive return roller 23*b* can be applied to the sheet.

FIGS. 23A to 23H are enlarged views of the reversing unit 7 for explaining a process of reversing a sheet P. As shown in FIGS. 23A to 23H, first and second switching claws 7*b* and 7*c* are arranged in a reverse switching unit 7*a* located at an inlet of the reversing unit 7. The switching claws 7*b* and 7*c* are positioned at an intersection of a reverse conveying path 7*d* used to convey the sheet P into the middle part (in a horizontal direction) and a vertical conveying path 7*v* used to convey the sheet P in a vertical direction. The conveying direction of the sheet P is switched by rotating the switching claws 7*b* and 7*c*.

Specifically, upon receiving a signal indicating a switching of the conveying direction of the sheet P depending on a folding pattern of the sheet P, a drive solenoid (not shown) included in each of the switching claws 7*b* and 7*c* is activated, and the switching claws 7*b* and 7*c* rotate around claw shafts 7*b*' and 7*c*', respectively, and thereby switching the conveying direction of the sheet P. The sheet is guided either to inside the reversing unit 7 or to be conveyed straight ahead by the switching claws 7*b* and 7*c* (i.e., to the reverse conveying path 7*d* or the vertical conveying path 7*v*). Guide plates 7*g* and 7*f* for guiding the sheet P conveyed inside the reversing unit 7 are respectively arranged on the upper and lower side of the reverse conveying path 7*d*, and an outlet 7*e* opened inside the middle part is provided in the most downstream side of the reverse conveying path 7*d*. A retractable sheet guide 7*i* is set up in such a way that the sheet guide 7*i* can extend outward through the outlet 7*e* in a direction E of inside the middle part (see FIG. 2), i.e., in the horizontal direction. With the sheet guide 7*i*, the sheet P can be guided or stocked properly regardless of a size of the sheet P, a size of the folded sheet P, and a folding pattern. In a case shown in FIG. 2, only a single unit of the sheet guide 7*i* is provided. Alternatively, it is also possible to provide two sheet guides on the top and bottom with the emphasis on a guiding performance.

The sheet is conveyed on the reverse conveying path 7*d* by reversible conveying rollers 7*r*1 and 7*r*2. As shown in FIG. 2, the guide plate (the reverse guide plate) 7*g* arranged on the upper side of the reverse conveying path 7*d* is openably supported by a supporting point 7*h*, and attached to the sheet post-processing device FR so that the reverse guide plate 7*g* is opened in the direction E. Driven rollers 7*r*1' and 7*r*2' are attached to the reverse guide plate 7*g*. The driven rollers 7*r*1' and 7*r*2' respectively have contact with the conveying rollers 7*r*1 and 7*r*2 with a predetermined pressure. Namely, the driven rollers 7*r*1' and 7*r*2' press the sheet P to the conveying rollers 7*r*1 and 7*r*2 with the pressure, and thereby applying a conveying power to the sheet P. When a paper jam occurs on the reverse conveying path 7*d*, it is possible to fix the paper jam because the reverse guide plate 7*g* can be opened.

Figure 23A:
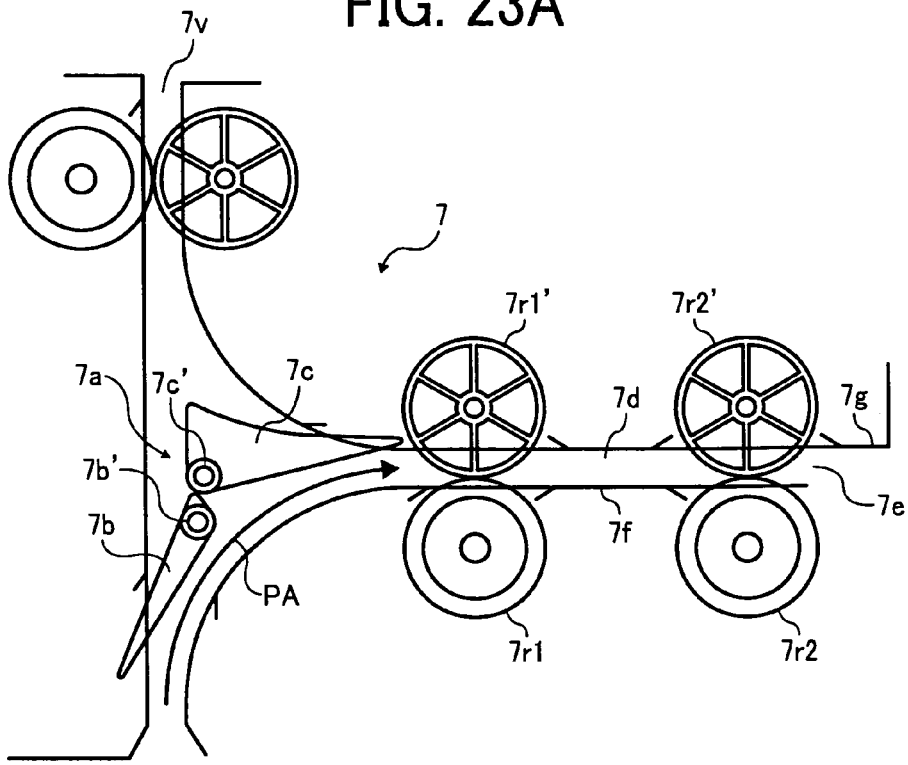
FIGS. 23A to 23D are schematic diagrams of an example of a reversing unit for explaining of a configuration and an operation of the reversing unit.

When the sheet P conveyed from the cross-folding unit 6 is to be reversed in the reversing unit 7, as shown in FIG. 23A, the first switching claw 7*b* rotates around the claw shaft 7*b*' in a clockwise (CW) direction in the drawing, and the second switching claw 7*c* rotates in a counterclockwise (CCW) direction to open the side of the reverse conveying path 7*d*. Consequently, the sheet P conveyed from the cross-folding unit 6 is further conveyed in a direction of an arrow PA shown in FIG. 23A to be guided to the side of the reverse conveying path 7*d*.

Figure 23B:
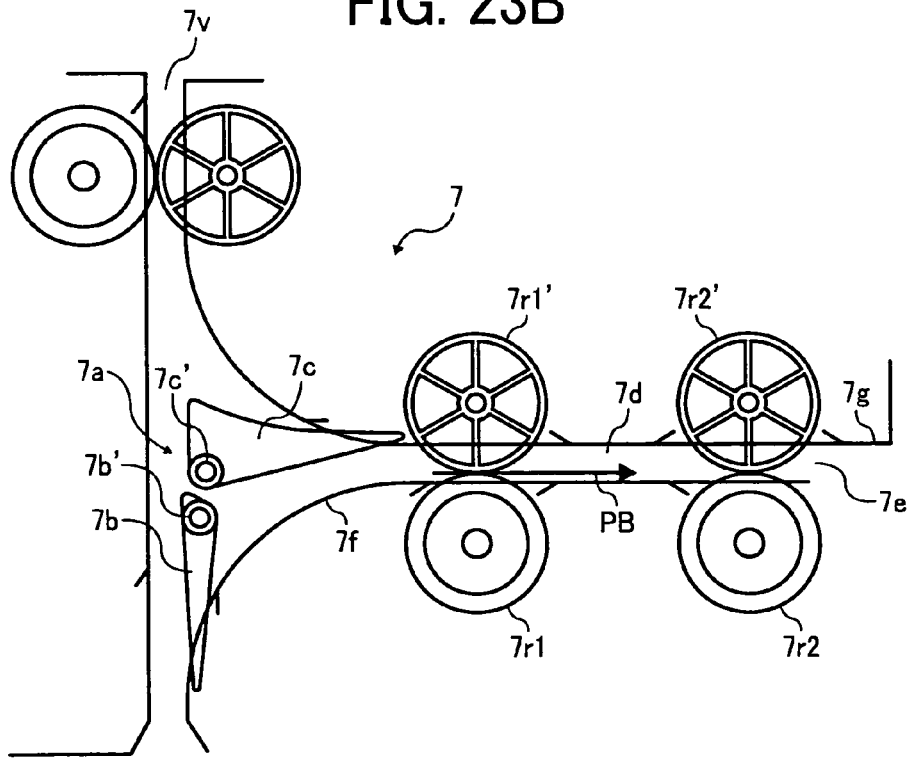
Figure 23C:
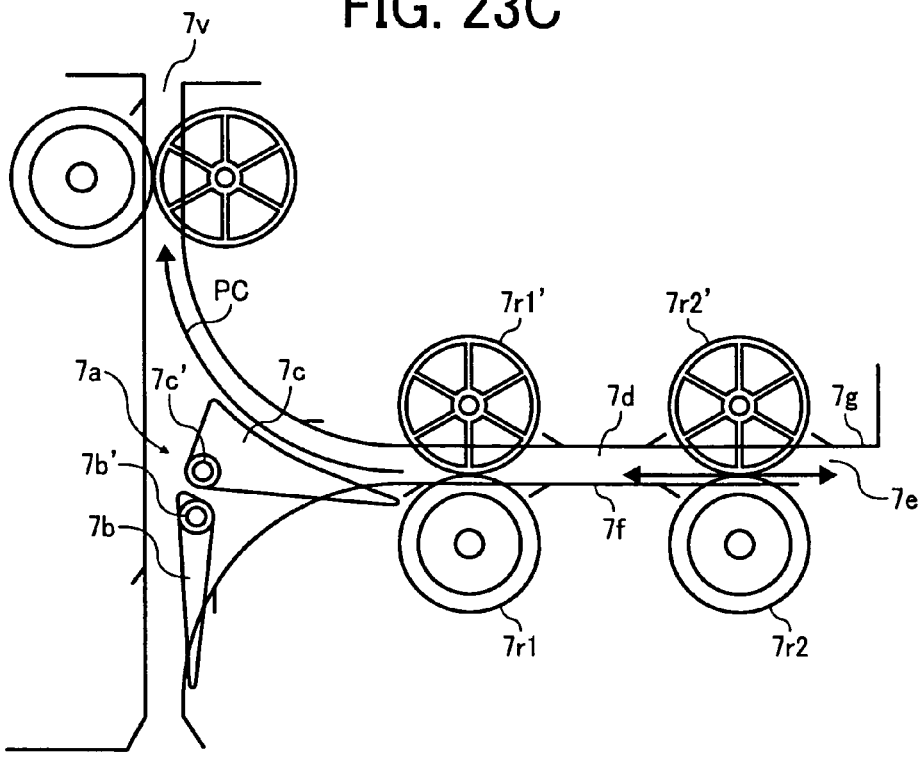

Subsequently, the sheet P is conveyed on the reverse conveying path 7*d* in a direction of an arrow PB shown in FIG. 23B, i.e., in the direction E. At this time, once a trailing edge of the sheet P passes through the first switching claw 7*b*, the first switching claw 7*b* rotates around the claw shaft 7*b*' in the CCW direction to close the reverse conveying path 7*d*, i.e., to release the side of the vertical conveying path 7*v*. Subsequently, once the trailing edge of the sheet P passes through the second switching claw 7*c*, as shown in FIG. 23C, the second switching claw 7*c* rotates around the claw shaft 7*c*' in the CW direction. At the same time, the conveying rollers 7*r*1 and 7*r*2 are reversed, so that the trailing edge of the sheet P is conveyed in a direction of the second switching claw 7*c*. Therefore, the sheet P is guided in a direction of an arrow PC by a side surface of the second switching claw 7*c*, and conveyed upward on the vertical conveying path 7*v*.

Figure 23D:
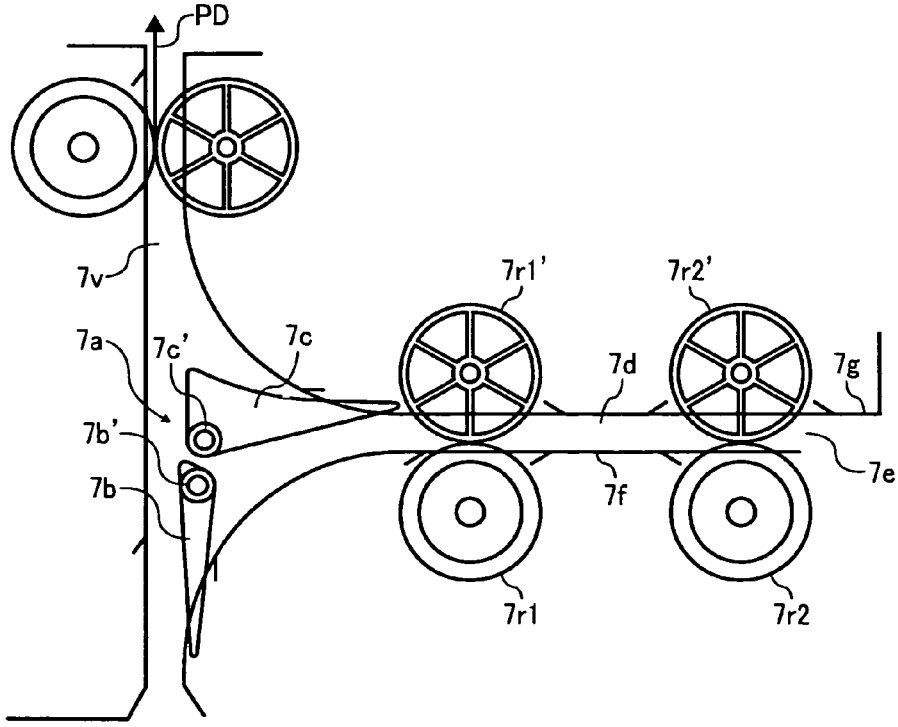

After the trailing edge of the sheet P passes through the second switching claw 7*c*, as shown in FIG. 23D, the second switching claw 7*c* rotates around the claw shaft 7*c*' in the CW direction to close a conveying path connecting from the reverse conveying path 7*d* to the vertical conveying path 7*v*, and open the vertical conveying path 7*v* on which the sheet P is conveyed from the cross-folding unit 6 to the side of the turning unit 8. In this manner, the sheet P from the cross-folding unit 6 is reversed, and then conveyed to the side of the turning unit 8 in a direction of an arrow PD.

Instead of the switching claws 7*b* and 7*c*, a switching guide plate can be used.

Figure 23E:
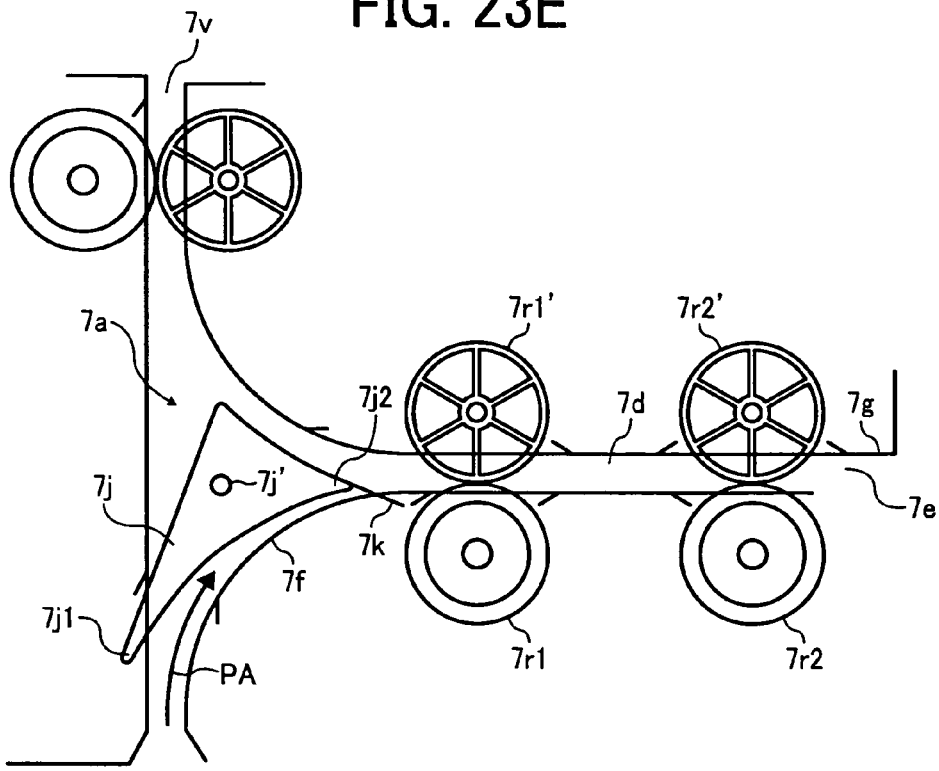
FIGS. 23E to 23H are schematic diagrams of another example of the reversing unit having a configuration different from that is shown in FIGS. 23A to 23D.

In a case shown in FIG. 23E, a switching guide plate 7*j* is arranged instead of the switching claws 7*b* and 7*c*. A cross section of the switching guide plate 7*j* has a schematically triangular shape, and the switching guide plate 7*j* is composed of a plurality of members attached around an axis 7*j*' in a pectinate manner. Incidentally, the switching claws 7*b* and 7*c* also have a plate-like shape, and each of the switching claws 7*b* and 7*c* is composed of a plurality of members attached around the claw shafts 7*b*' and 7*c*' in a pectinate manner, respectively. A lower end portion 7*j*1 of the switching guide plate 7*j* is used to convey the sheet P to the vertical conveying path 7*v* and also to guide the sheet P to the side of the reverse conveying path 7*d*. An end portion 7*j*2 on the side of the vertical conveying path 7*v* (in the case shown in FIG. 23E, a right end portion) of the switching guide plate 7*j* is used to convey the sheet P to the reverse conveying path 7*d* and also to guide the sheet P from the reverse conveying path 7*d* to the vertical conveying path 7*v*.

Figure 23F:
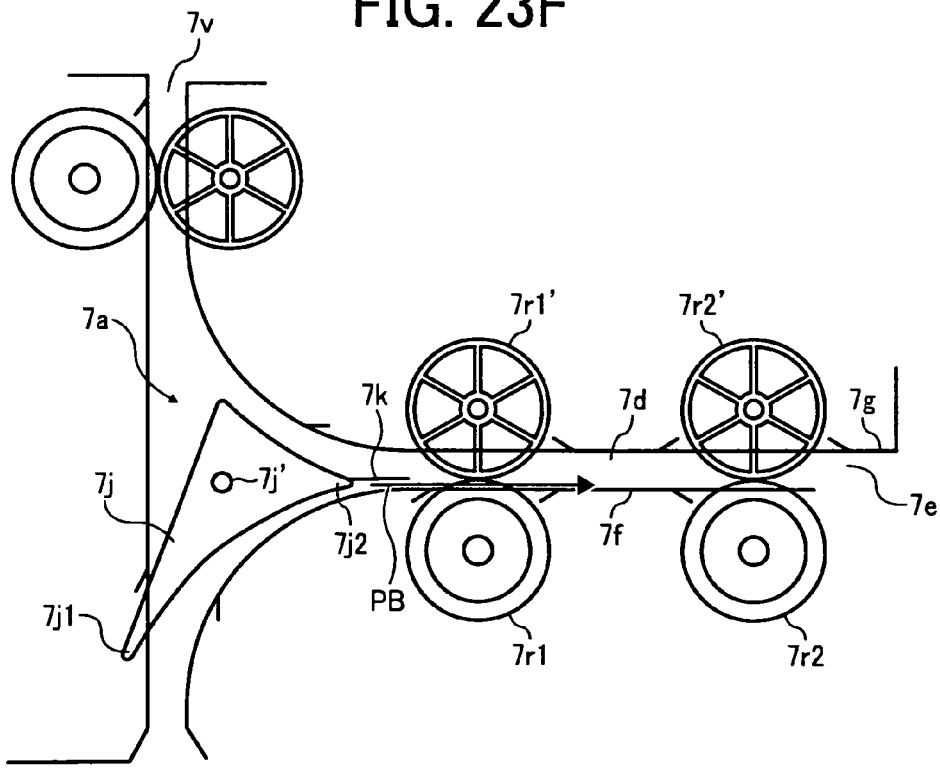

A basal portion of a sheet-like elastic guide member 7*k* is attached onto an upper surface of the switching guide plate 7*j* in such a way that the elastic guide member 7*k* is laterally projected from the end portion 7*j*2. As shown in FIG. 23E, when the switching guide plate 7*j* guides the sheet P from the vertical conveying path 7*v* to the reverse conveying path 7*d*, the elastic guide member 7*k* is located so as to cross the guide plate 7*f* on the lower side of the reverse conveying path 7*d*. As shown in FIG. 23F, when the sheet P is conveyed to the side of the reverse conveying path 7*d*, a leading edge of the sheet P pushes up a bottom surface of the elastic guide member 7*k*, and is conveyed into the reverse conveying path 7*d*.

Figure 23G:
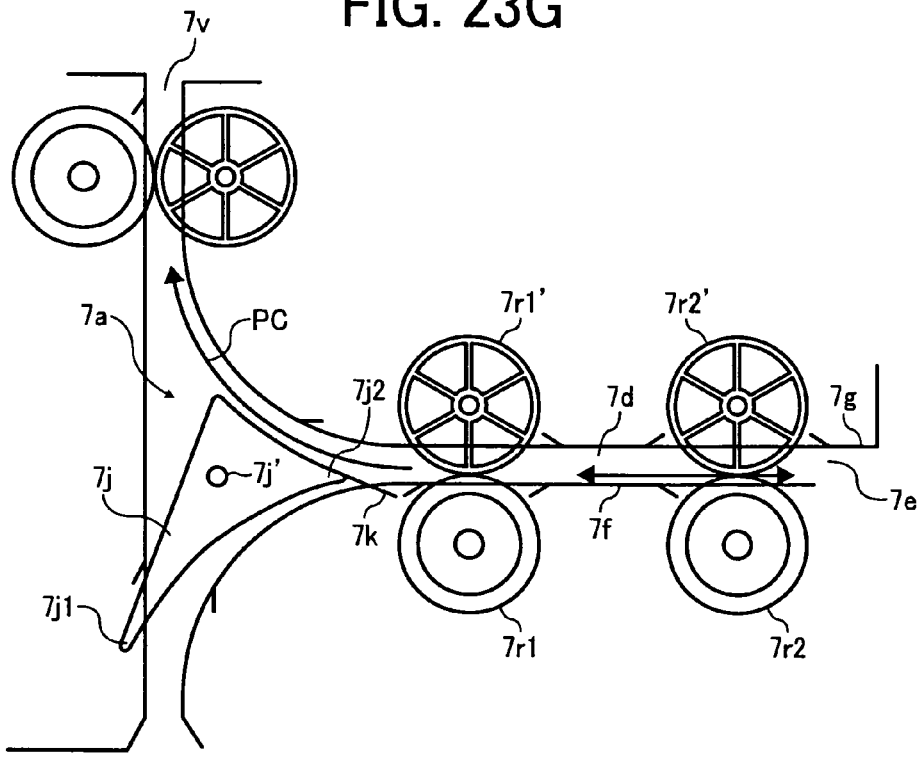
Figure 23H:
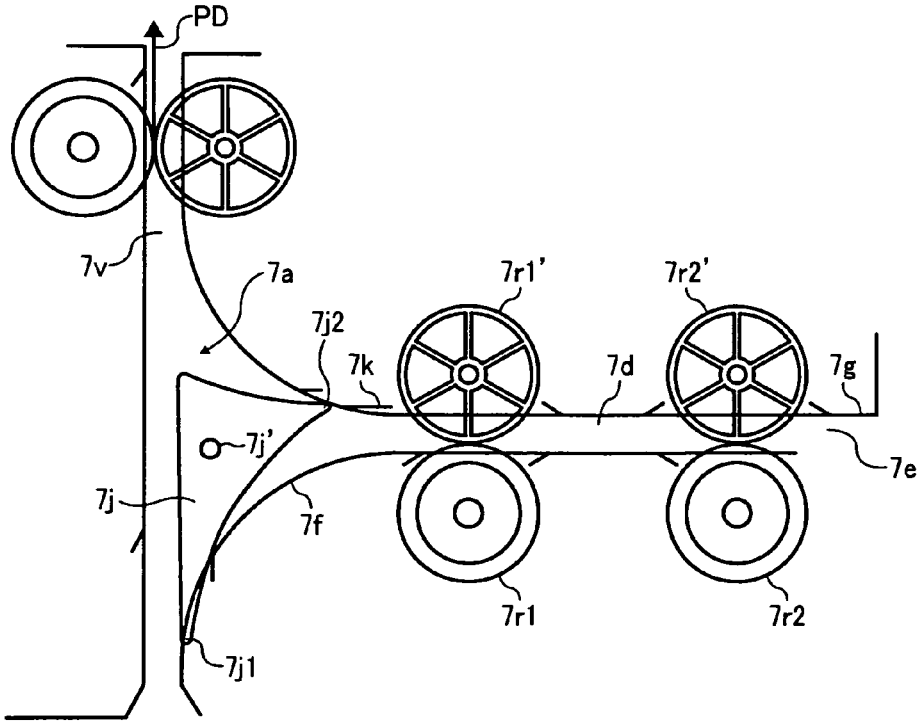

When the sheet P is wholly conveyed into the reverse conveying path 7*d*, as explained above with reference to FIG. 23C, the conveying rollers 7*r*1 and 7*r*2 are reversed, and start conveying the sheet P in a switchback manner in a direction opposite to the direction of which the sheet P is conveyed to the reverse conveying path 7*d*. At this time, the elastic guide member 7*k* is back in an initial state, so that as shown in FIG. 23G, the sheet P is conveyed on an upper surface of the elastic guide member 7*k*, and guided upward onto the vertical conveying path 7*v* by the upper surface of the switching guide plate 7*j*. When the sheet P is not to be reversed, the switching guide plate 7*j* rotates from a position as shown in FIG. 23E in the CCW direction in the drawing to be back to an initial position as shown in FIG. 23H so as to open the vertical conveying path 7*v*, and thus the sheet P is conveyed upward on the vertical conveying path 7*v*. Incidentally, the initial position of the switching guide plate 7*j* is a position shown in FIG. 23H.

The switching guide plate 7*j* is driven to rotate around the axis 7*j*' by a drive solenoid (not shown) included in the switching guide plate 7*j* in the same manner as the switching claws 7*b* and 7*c*. The portions identical to those in FIGS. 23A to 23D for the case of the switching claws 7*b* and 7*c* are denoted with the same reference numerals and the description of those portions is omitted.

In the present embodiment, each of the switching claws 7*b* and 7*c* and the switching guide plate 7*j* serves as a guide member, and is composed of a plurality of members attached around each shaft in a pectinate manner. Alternatively, each of the switching claws 7*b* and 7*c* and the switching guide plate 7*j* can be composed of one member to be integrated with the member in a longitudinal direction.

Figure 24A:
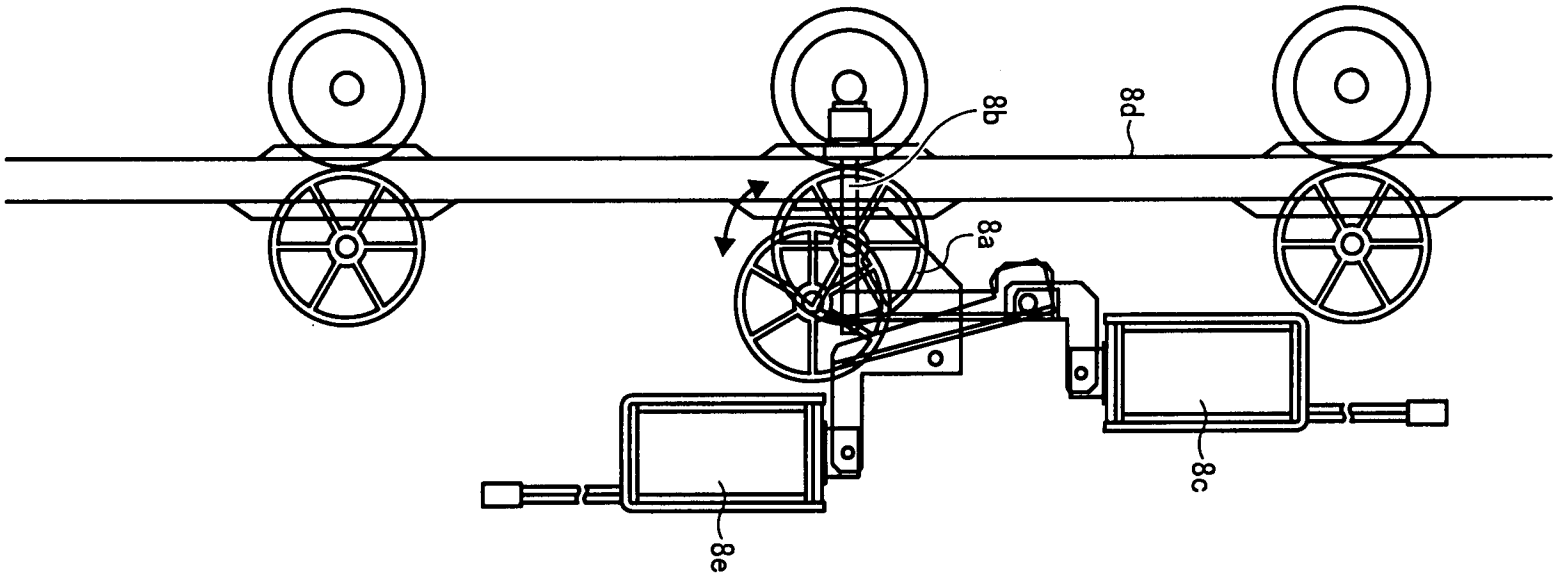
FIG. 24A is a front view of a turning unit.
Figure 24B:
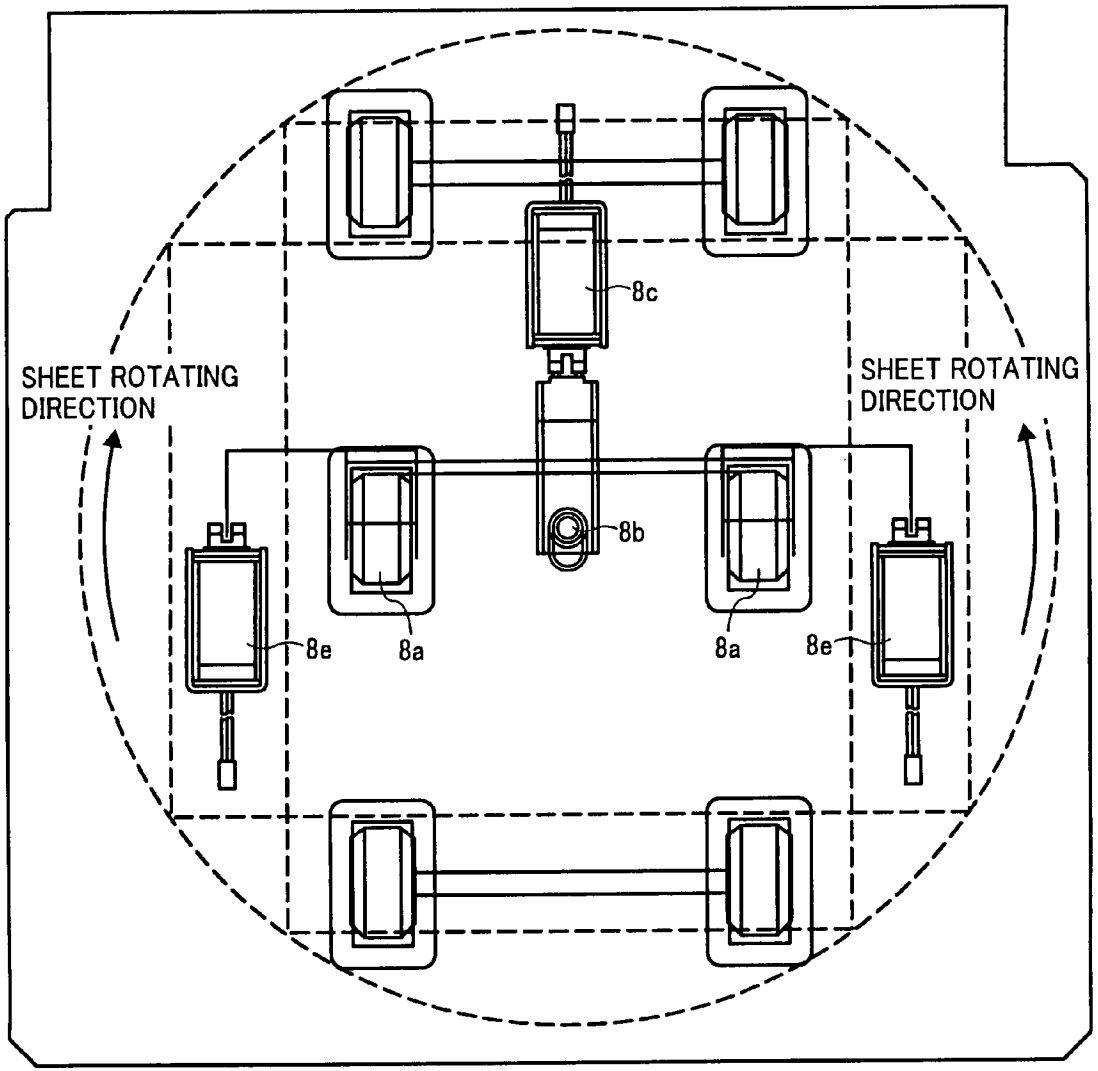
FIG. 24B is a side view of the turning unit.

Subsequently, when the sheet P is conveyed back onto the vertical conveying path 7*v*, the sheet P is conveyed into the turning unit 8 arranged downstream of the reversing unit 7, and horizontally turned 90 degrees by a rotating roller 8*a* as shown in FIGS. 24A and 24B. Incidentally, the vertical conveying path 7*v* including the turning unit 8 arranged downstream of the reversing unit 7 can be opened to the inner side of the middle part, so that a paper jam can be easily fixed.

A configuration of the turning unit 8 is explained in detail below. As shown in FIGS. 24A and 24B, a pair of the rotating rollers 8*a* are arranged on the left and right sides of the turning unit 8 with respect to the conveying direction of the sheet, and a press shaft 8*b* that presses the sheet from a direction of the front or rear side of the sheet is arranged on a center portion of an axis line of the rotating rollers 8*a*. When the sheet is conveyed into the turning unit 8, a solenoid 8*c* of the press shaft 8*b* is activated, and the press shaft 8*b* holds a center portion of the sheet with its tip portion. The tip portion of the press shaft 8*b* having contact with the sheet has a spherical shape so that the sheet can rotate smoothly. Then, by a rotation of either one of the rotating rollers 8*a*, the other rotating roller 8*a* is released from the pressure, so that the sheet which center portion is held by the press shaft 8*b* rotates 90 degrees to either the left or right side so that the sheet can be put on the tray 9 properly when discharged onto the tray 9 depending on a folding pattern, and then discharged onto the tray 9. As shown in FIG. 24A, a pressure movement and a pressure-release movement of the rotating rollers 8*a* is performed by a solenoid 8*e* for driving the rotating rollers 8*a*. Namely, the solenoid 8*e* is arranged on the same side as the solenoid 8*c*, and moves up and down a supporting frame of each of the rotating rollers 8*a*. To stack a plurality of discharged sheets on the tray 9, a height of the tray 9 moves up and down depending on the number of discharged sheets. A conveyance guide plate 8*d* on the side of the middle part of the turning unit 8 (inside the sheet folding device 1) is arranged to be openable in a direction of the inner side of the middle part so that a paper jam in the turning unit 8 can be fixed.

Subsequently, a skew correcting mechanism included in the sheet folding device 1 is explained below. FIG. 3 is a top plan view of the conveyance switching unit 5 shown in FIG. 2 viewed from above. FIG. 4 is an enlarged view of the conveyance switching unit 5 shown in FIG. 1. A sheet P shown in FIG. 4 is the sheet which corner is folded by the corner folding unit 3, and accordion-folded in the conveying direction by the accordion-folding unit 4. With a rotation of the inlet conveying roller 20 in a direction as indicated by an arrow shown in FIG. 4, a leading edge of the sheet P has contact with a guide plate 29 for guiding the sheet P to the jogger fences 22*a* and 22*b*, and is conveyed along the guide plate 29 to be dropped into an area between the jogger fences 22*a* and 22*b*. At this time, as shown in FIG. 4, the jogger fence 22*a* on the upstream side is configured to stand by below the inlet conveying roller 20. When a jogger motor 39 shown in FIG. 17 rotates in a CW direction, a drive belt 37 fixed to the jogger fences 22*a* and 22*b* rotates in a direction as indicated by arrows by a rotation transmission from the jogger motor 39 via a jogger motor pulley 39*a*, a drive belt 40, a pulley 38, and a pulley 36, and thereby closing the jogger fences 22*a* and 22*b*.

At this time, when a jogger-fence home-position light-shielding plate 22*e* fixed to the jogger fence 22*a* is in a stand-by position, a jogger-fence home-position sensor 28 is powered ON by being shielded by the jogger-fence home-position light-shielding plate 22*e*. On the other hand, when the jogger fences 22*a* and 22*b* move, the jogger-fence home-position sensor 28 is powered OFF, so that moving amounts of the jogger fences 22*a* and 22*b* are determined depending on a timing when the jogger motor 39 starts driving. The jogger fences 22*a* and 22*b* move in proportion to a rotation of the jogger motor 39. Namely, the jogger fences 22*a* and 22*b* are arranged to have the same distances from the cross-folding unit 6 and the center of a conveying path of the turning unit 8, so that the center of the sheet P can be kept constant regardless of the width of the sheet P.

As shown in FIG. 13, the jogger fence 22*b* on the downstream side is configured to be capable of rotating around a rotating center 22*c*. A long hole 22*d* of the jogger fence 22*b* and a jogger-fence swinging solenoid 27 are connected to each other. When the jogger-fence swinging solenoid 27 is powered ON, the jogger fence 22*b* rotates around the rotating center 22*c* to move away from a sheet conveying path. The sheet P conveyed into the jogger fences 22*a* and 22*b* can be conveyed either upward or downward in a longitudinal direction by the return rollers 23*a* and 23*b*. A plurality of the return rollers 23*a* and 23*b* are arranged so as to convey the sheet P even when a size or a folding pattern of the sheet P varies. Furthermore, as shown in FIG. 12, the return rollers 23 are arranged opposite to a punched hole (a hole position) that are punched by the lateral-hole punching unit 10.

The return rollers 23*a* and 23*b* in the present embodiment are arranged near the upstream side of the jogger fence 22*a*. As shown in FIG. 17, the pulley 34 fixed to axes of the return rollers 23*a* and 23*b* is connected to the drive belt 35, the pulley 32, the drive belt 31, and a longitudinal conveying motor pulley 30*a*. When the longitudinal conveying motor 30 rotates in a CCW direction as indicated by an arrow shown in FIG. 17, the drive return roller 23*b* shown in FIG. 4 rotates in a direction in which the drive return roller 23*b* has contact with the jogger fence 22*b* on the downstream side. On the other hand, when the longitudinal conveying motor 30 rotates in a CW direction opposite to the direction as indicated by the arrow shown in FIG. 17, the drive return roller 23*b* rotates in a direction in which the drive return roller 23*b* has contact with the jogger fence 22*a* on the upstream side.

A pulley 33 fixed to an axis of the inlet conveying roller 20 is also connected to the drive belt 35, the pulley 32, the drive belt 31, and the longitudinal conveying motor pulley 30*a* in the same manner as the pulley 34 (see FIG. 17). When the longitudinal conveying motor 30 rotates in the CCW direction, the inlet conveying roller 20 rotates in a direction of an arrow, i.e., in a direction in which the inlet conveying roller 20 conveys a sheet to drop the sheet into jogger fences 22 (the jogger fences 22*a* and 22*b*). When the inlet conveying roller 20 conveys a sheet P to drop the sheet P into the jogger fences 22, the driven return roller 23*a* moves away from the drive return roller 23*b*, and stands by at a stand-by position where the driven return roller 23*a* does not have contact with the drive return roller 23*b* as shown in FIG. 4.

Figure 6:
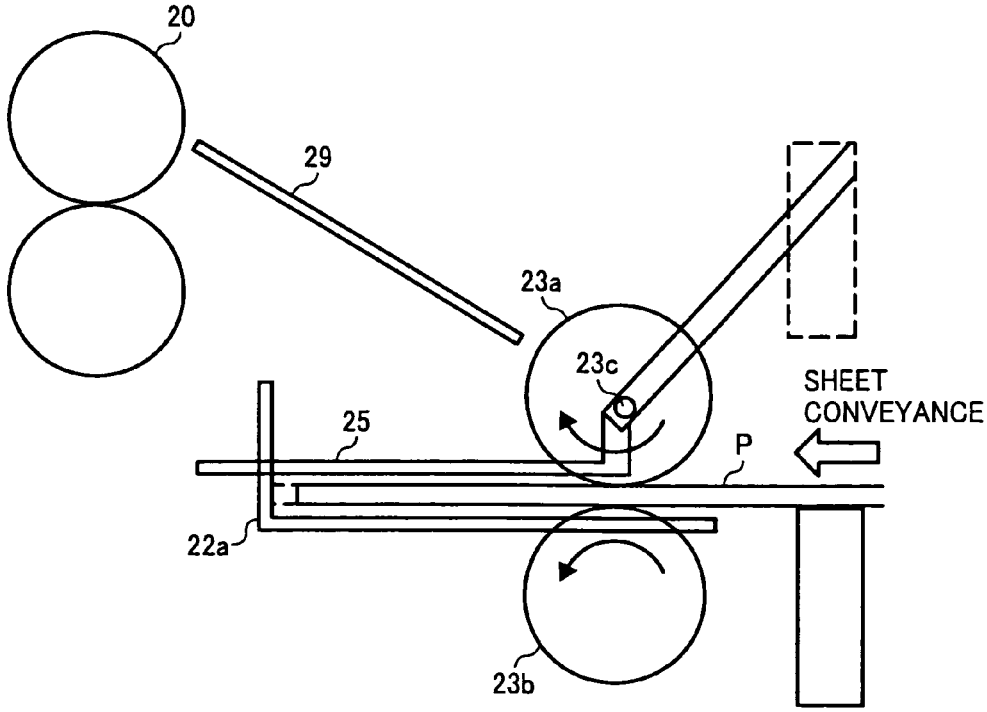
FIG. 6 is a side view of the sheet processing unit shown in FIG. 5.

When the longitudinal conveying motor 30 rotates, and the drive return roller 23*b* conveys the sheet P, as shown in FIG. 19, the solenoid 49 is powered ON, and a longitudinal-conveyance swinging lever 47 is pulled, so that the longitudinal conveying arm 26 rotates around the supporting point 26*a* from a position indicated by a dashed-two dotted line to a position indicated by a solid line, the driven return roller 23*a* attached to the longitudinal conveying arm 26 via the pressure spring 46 has contact with the drive return roller 23*b* to apply a pressure to the drive return roller 23*b*. On the other hand, when the solenoid 49 is powered OFF, the longitudinal-conveyance swinging lever 47 is released, the longitudinal conveying arm 26 rotates around the supporting point 26*a* from the position indicated by the solid line to the position indicated by the dashed-two dotted line, the driven return roller 23*a* attached to the longitudinal conveying arm 26 moves away from the drive return roller 23*b*. In addition, as shown in FIGS. 4 and 6, a press guide 25 is rotatably attached to the axis 23*c* of the driven return roller 23*a*. When the driven return roller 23*a* has contact with the sheet P as shown in FIG. 6, the press guide 25 is configured to press a top surface of the sheet P.

As shown in FIGS. 3 and 4, the sheet P conveyed into the jogger fences 22*a* and 22*b* is conveyed to the cross-folding unit 6 on the downstream side by the lateral conveying rollers 24. As shown in FIG. 18, a pulley 41 fixed onto the same axis of lateral conveying drive rollers 24*b* is connected to a drive belt 42, a pulley 43, a drive belt 44, a lateral conveying motor pulley 45*a*. When a lateral conveying motor 45 rotates in the CCW direction as indicated by an arrow, the lateral conveying drive rollers 24*b* are driven to rotate in a direction in which the sheet P is conveyed to the cross-folding unit 6.

As shown in FIG. 20, lateral conveying driven rollers 24*a* are connected to a lateral-conveyance swinging pressure bracket 50 via each of axes 24*c* of the lateral conveying driven rollers 24*a* and springs 51. A line of a plurality of the lateral conveying driven rollers 24*a* is supported by the lateral-conveyance swinging pressure bracket 50, and the lateral-conveyance swinging pressure bracket 50 rotates around a rotating center 50*a* in an swinging manner between a stand-by position indicated by a dashed-two dotted line and a position indicated by a solid line. The lateral-conveyance swinging pressure bracket 50 is rotatably connected to a lateral-conveyance swinging pressure arm 53 at a supporting point 50*b*. The lateral-conveyance swinging pressure arm 53 is rotatably connected to a lateral-conveyance swinging lever 54 fixed to a pulley 55 at a supporting point 53*a*. The pulley 55 is connected to a pulley fixed to a lateral-conveyance swinging pressure motor 57 via a belt 56.

When the lateral-conveyance swinging pressure motor 57 rotates in the CW direction shown in FIG. 20, the lateral conveying driven rollers 24*a* located in the position indicated by the solid line, i.e., the position in which the lateral conveying driven rollers 24*a* have contact with the lateral conveying drive rollers 24*b* move away to the stand-by position indicated by the dashed-two dotted line. On the other hand, when the lateral-conveyance swinging pressure motor 57 rotates in the CCW direction, the lateral conveying driven rollers 24*a* move from the stand-by position indicated by the dashed-two dotted line to the position indicated by the solid line, i.e., the position in which the lateral conveying driven rollers 24*a* have contact with the lateral conveying drive rollers 24*b*. The lateral-conveyance swinging pressure arm 53 includes a home-position detecting light-shielding plate 50*c*, and detects whether the lateral conveying driven rollers 24*a* are located in the stand-by position indicated by the dashed-two dotted line with a home-position sensor 52.

As shown in FIG. 3, the lateral-hole punching unit 10 is arranged on the right downstream side of the jogger fence 22*b* to be aligned in parallel to the jogger fence 22*b*, and the longitudinal-hole punching unit 11 is arranged perpendicular to a lateral conveying direction. As shown in FIG. 21, the lateral-hole punching unit 10 includes a drive shaft 10*a* for driving a lateral-hole punch to move up and down so as to punch a lateral hole in a sheet, and a lateral-hole punching clutch 60 is attached to the drive shaft 10*a*. In addition, a home-position light-shielding plate 62 for lateral-hole punching is fixed to the drive shaft 10*a*. The lateral-hole punching clutch 60 is connected to a lateral-hole punching motor 63. When the home-position light-shielding plate 62 for lateral-hole punching is powered ON, the home-position light-shielding plate 62 for lateral-hole punching shields a home-position sensor 61 for lateral-hole punching at a stand-by position, and the home-position sensor 61 is powered ON.

When the home-position sensor 61 is powered ON, the lateral-hole punching motor 63 starts rotating, the lateral-hole punching clutch 60 is powered ON, the drive shaft 10*a* rotates, the punch moves up and down to punch a lateral hole in a sheet, the drive shaft 10*a* rotates 360 degrees, the home-position light-shielding plate 62 for lateral-hole punching shields the home-position sensor 61 for lateral-hole punching, the home-position sensor 61 is powered ON again, the lateral-hole punching clutch 60 is powered OFF, and the lateral-hole punching clutch 60 stops at the stand-by position. A sheet-leading-edge detecting sensor 12 for lateral-hole punching is arranged just anterior to an inlet of the lateral-hole punching unit 10, and detects a leading edge of a sheet P to be punched with a lateral hole. By detecting the leading edge of the sheet P, a timing to stop conveying the sheet P in the lateral-hole punching unit 10 can be determined.

In the same manner as the lateral-hole punching unit 10, the longitudinal-hole punching unit 11 includes a drive shaft 11*a* for driving a longitudinal-hole punch to move up and down so as to punch a longitudinal hole in a sheet, and a longitudinal-hole punching clutch 64 is attached to the drive shaft 11*a*. In addition, a home-position light-shielding plate 66 for longitudinal-hole punching is fixed to the drive shaft 11*a*. The longitudinal-hole punching clutch 64 is connected to a longitudinal-hole punching motor 67. When the home-position light-shielding plate 66 for longitudinal-hole punching is powered ON, the home-position light-shielding plate 66 for longitudinal-hole punching shields a home-position sensor 65 for longitudinal-hole punching at a stand-by position, and the home-position sensor 65 is powered ON.

When the home-position sensor 65 is powered ON, the longitudinal-hole punching motor 67 starts rotating, the longitudinal-hole punching clutch 64 is powered ON, the drive shaft 11*a* rotates, the punch moves up and down to punch a longitudinal hole in a sheet, the drive shaft 11*a* rotates 360 degrees, the home-position light-shielding plate 66 for longitudinal-hole punching shields the home-position sensor 65 for longitudinal-hole punching, the home-position sensor 65 is powered ON again, the longitudinal-hole punching clutch 64 is powered OFF, and the longitudinal-hole punching clutch 64 stops at the stand-by position. A sheet-leading-edge detecting sensor 13 for longitudinal-hole punching is arranged just anterior to an inlet of the longitudinal-hole punching unit 11, and detects a leading edge of a sheet P to be punched with a longitudinal hole. By detecting the leading edge of the sheet P, a timing to stop conveying the sheet P in the longitudinal-hole punching unit 11 can be determined.

As shown in FIG. 10, the longitudinal-hole punching unit 11 is arranged in a tilted manner so that punch chips generated due to punching are dropped into a longitudinal-hole punch chip tray 11*c*. As for a drive configuration, a conveying-direction switching punch controller 100 controls each of the motors as shown in FIG. 22. Upon receiving an input signal indicating a folding pattern, a size, and the like from an operating unit 201 of the main body 200, a main-body control board 202 outputs information indicated in the input signal to a cross control board. Based on the information, the cross control board controls each of the motors to convey or punch a sheet.

FIG. 22 is a block diagram for explaining an electrical configuration of the system including the sheet folding device 1 and the main body 200 of the copying machine according to the present embodiment. The main body 200 includes the operating unit 201 and the main-body control board 202. The sheet folding device 1 includes the conveying-direction switching punch controller 100, the sheet-leading-edge detecting sensor 12 for lateral-hole punching, the sheet-leading-edge detecting sensor 13 for longitudinal-hole punching, the inlet sensor 21*a*, the inlet sensor (for corner folding) 21*b*, the home-position sensor 52, the home-position sensor 61 for lateral-hole punching, the home-position sensor 65 for longitudinal-hole punching, the jogger-fence home-position sensor 28, the longitudinal conveying motor 30, the jogger motor 39, the lateral conveying motor 45, the lateral-conveyance swinging pressure motor 57, the lateral-hole punching motor 63, the longitudinal-hole punching motor 67, a conveying-direction switching claw solenoid 15, the jogger-fence swinging solenoid 27, the solenoid 49, the lateral-hole punching clutch 60, and the longitudinal-hole punching clutch 64. All the units included in the sheet folding device 1 other than the conveying-direction switching punch controller 100 are connected to the conveying-direction switching punch controller 100, and the conveying-direction switching punch controller 100 controls the units depending on a detection output from each of the sensors. Such a control process is performed by a central processing unit (CPU) (not shown) of the conveying-direction switching punch controller 100 by using a read-only memory (ROM) (not shown) as a working area in accordance with a computer program stored in a random access memory (RAM) (not shown).

Figure 25A:
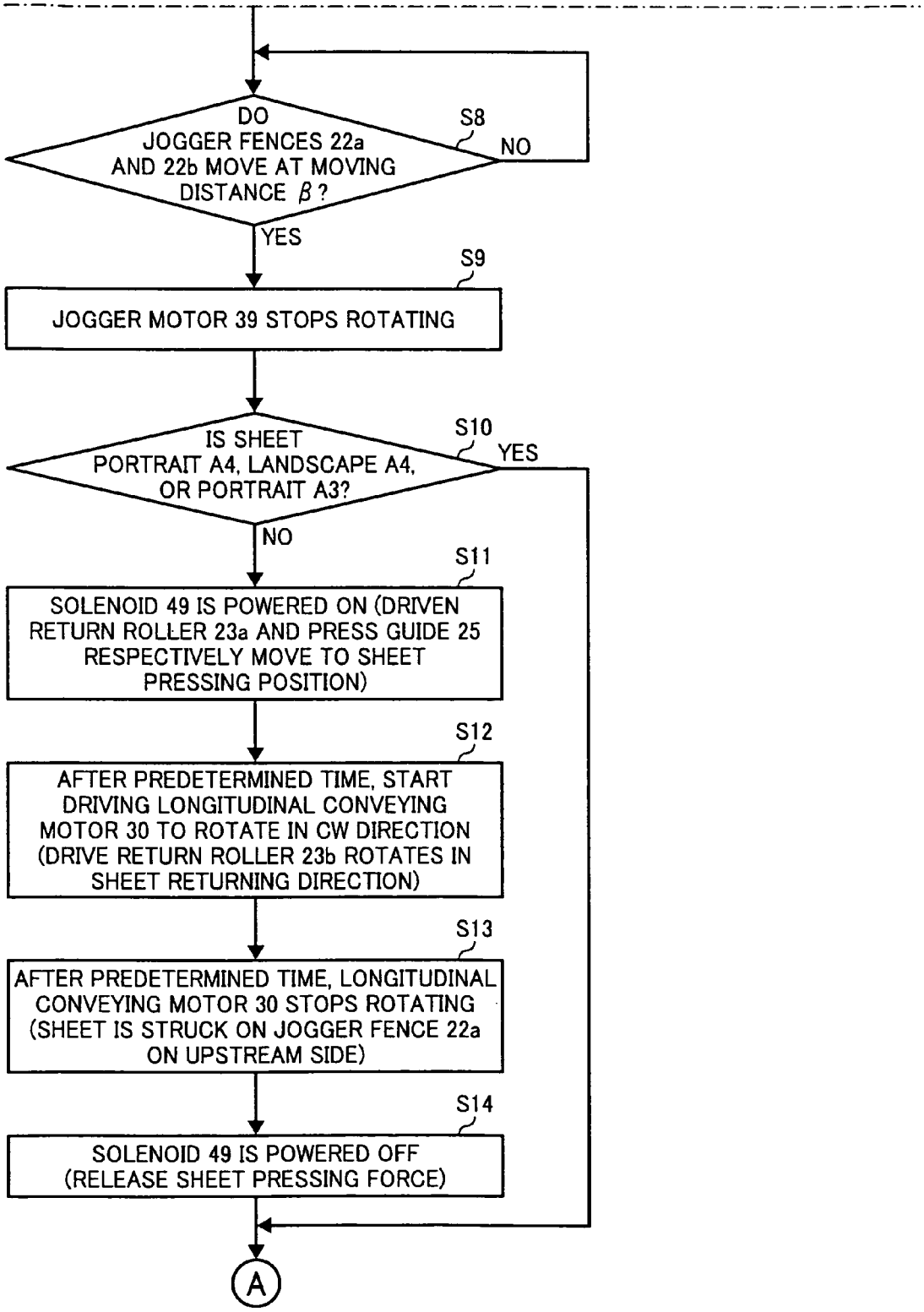
FIG. 25A is a flowchart of a skew correcting process.
Figure 25B:
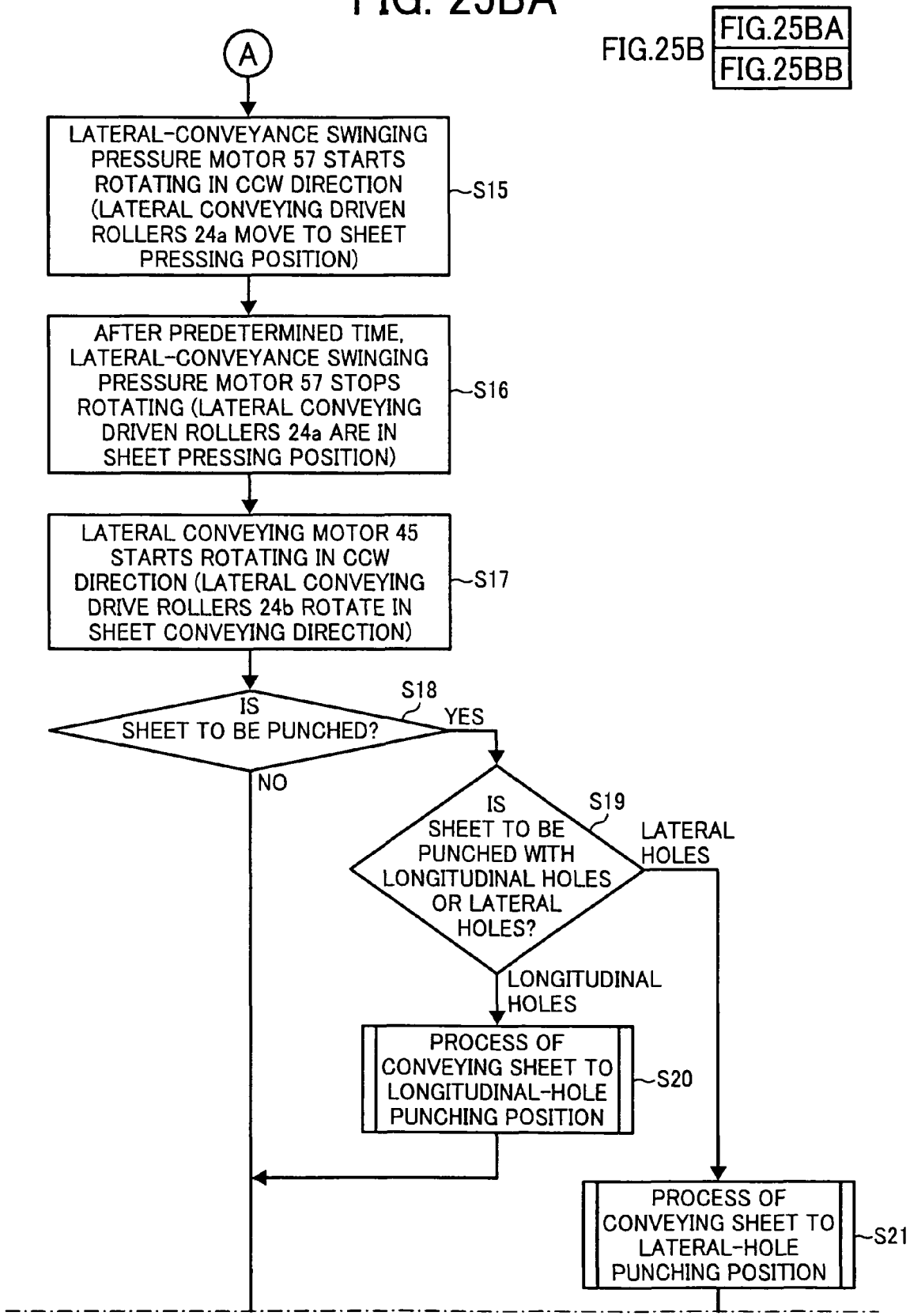
FIG. 25B is a continuation of the flowchart shown in FIG. 25A.
Figure 25B:
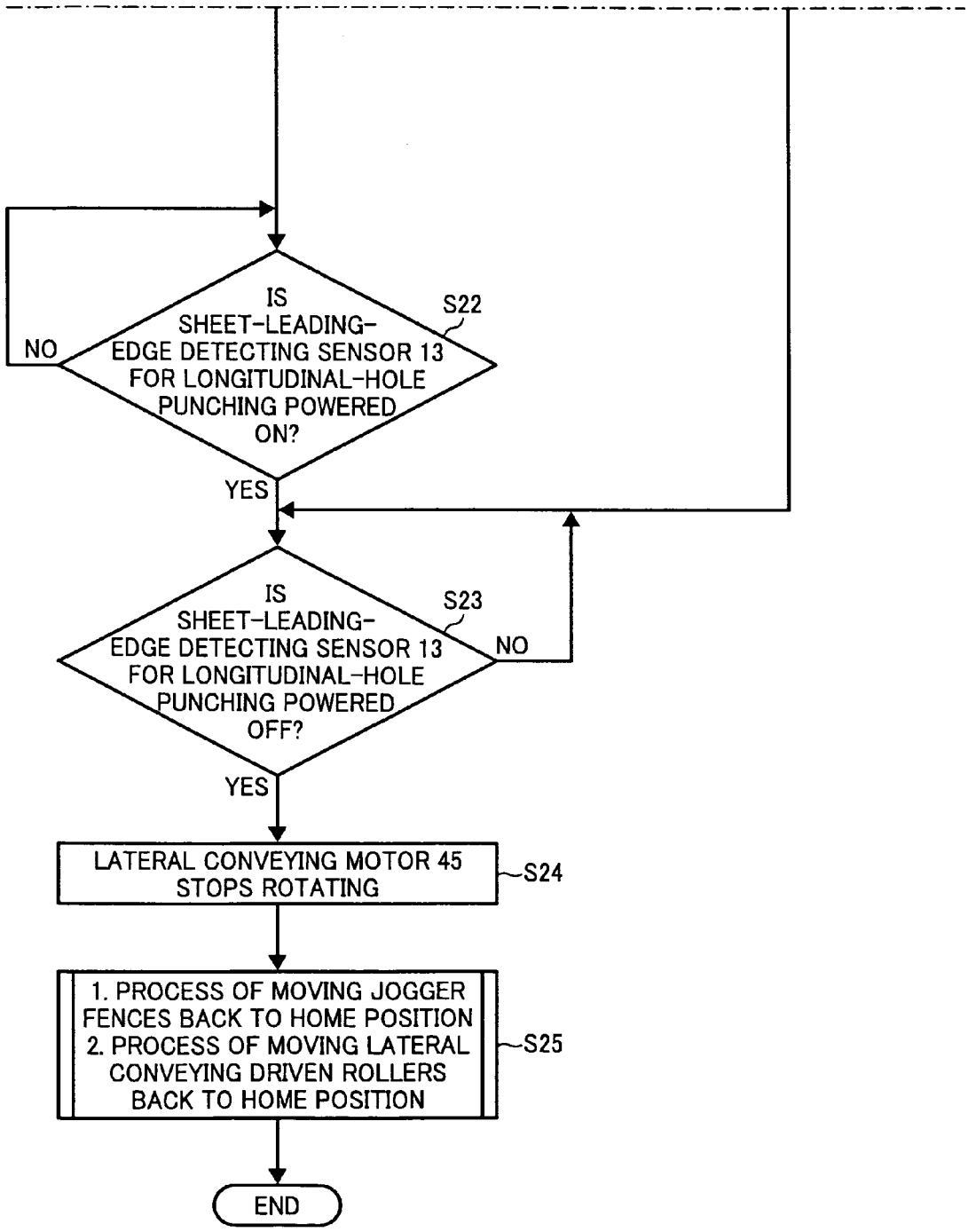
Figure 31A:
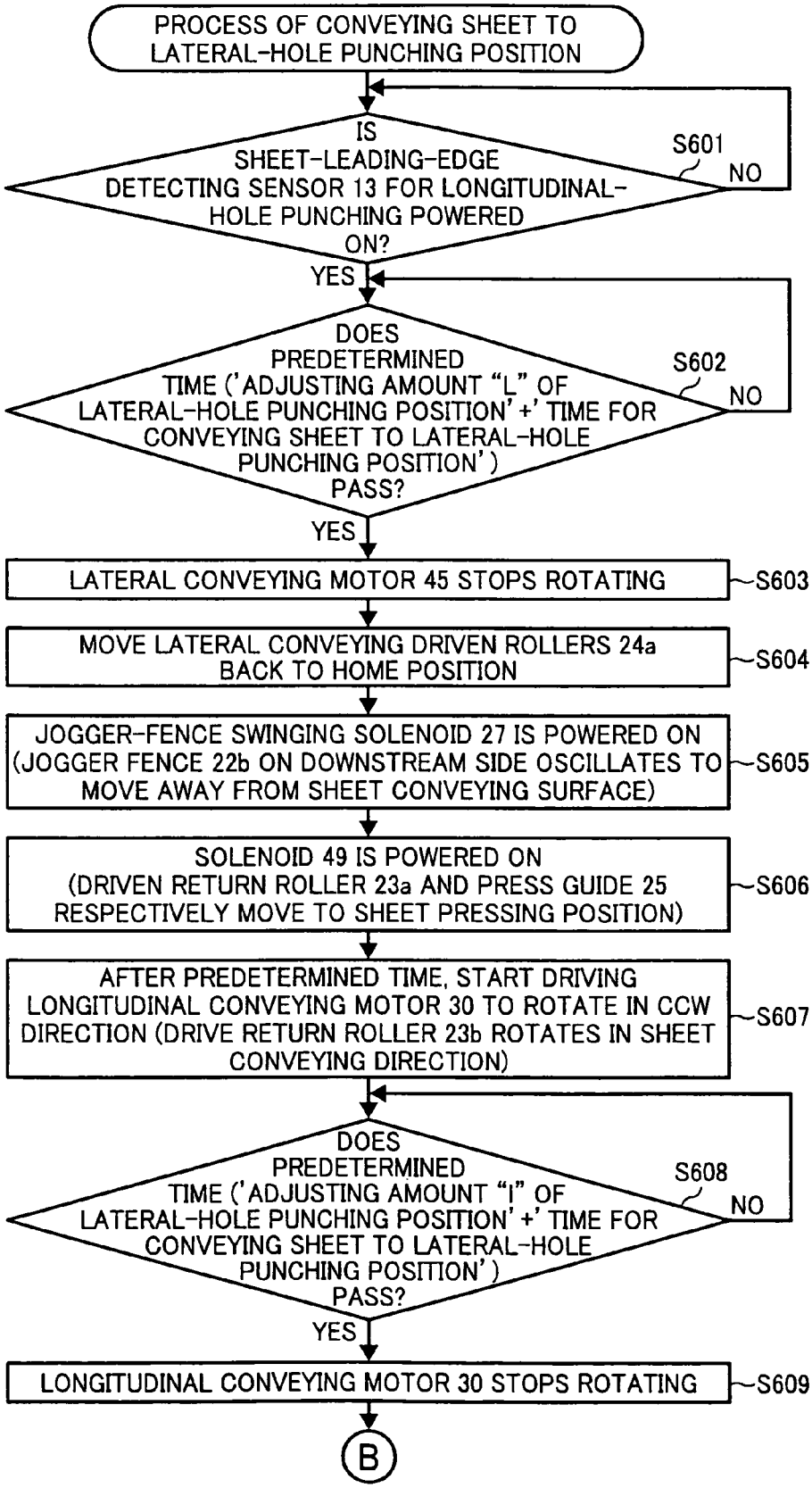
FIG. 31A is a flowchart of a process of moving a sheet to a lateral-hole punching position.
Figure 31B:
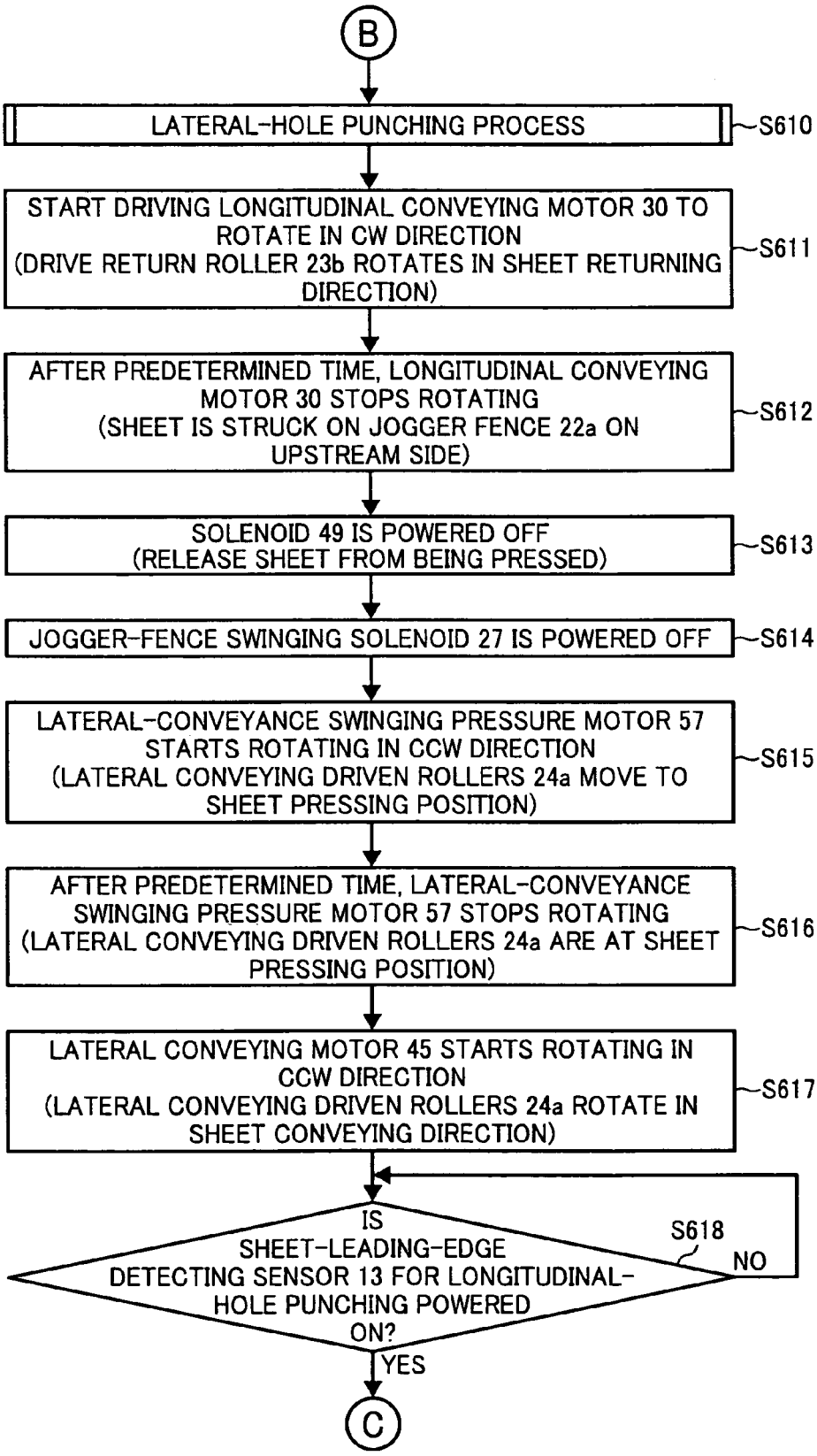
FIG. 31B is a continuation of the flowchart shown in FIG. 31A.
Figure 31C:
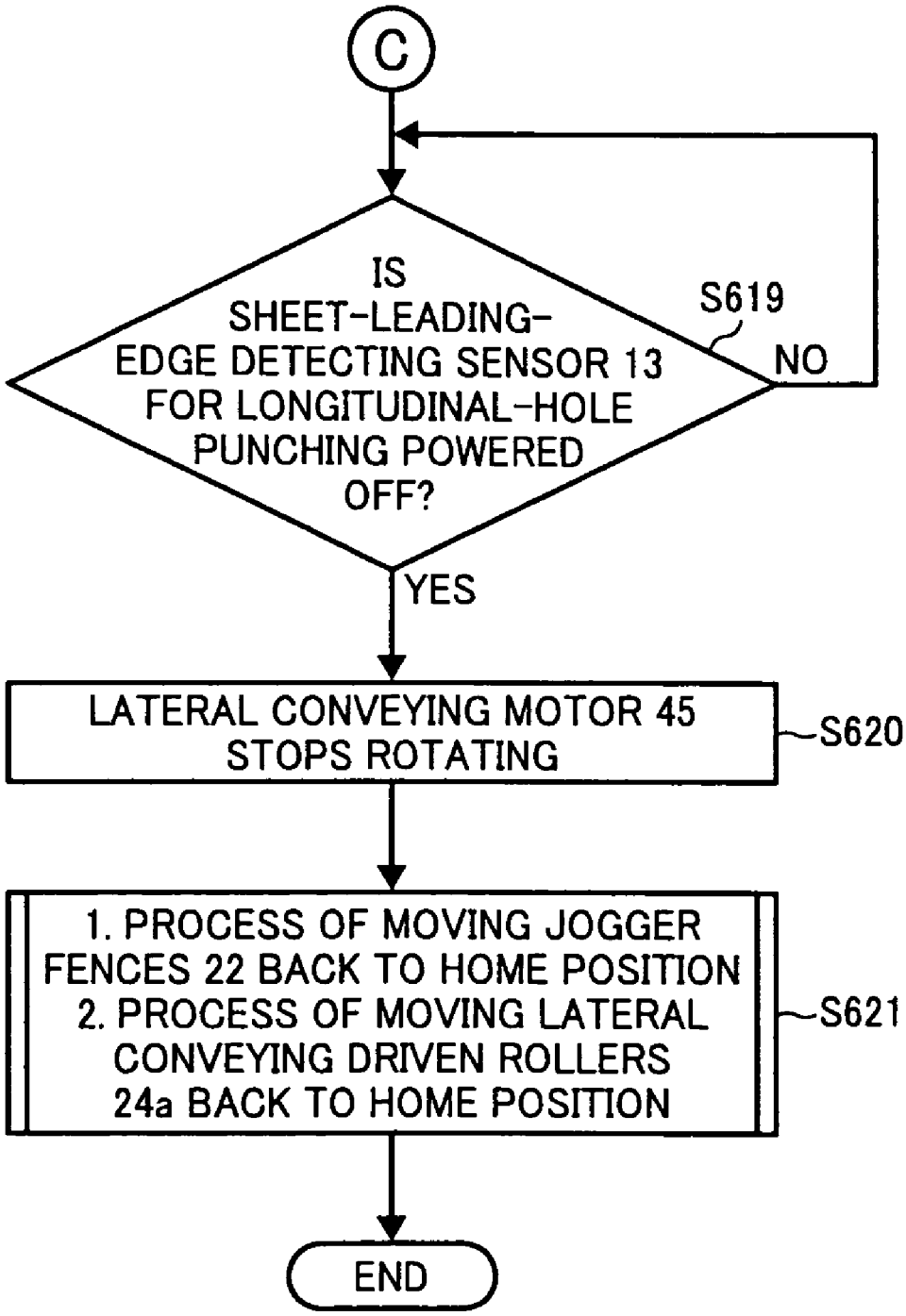
FIG. 31C is a continuation of the flowchart shown in FIG. 31B.

FIGS. 25A, 25B, and 31 are flowcharts of the control process performed by the conveying-direction switching punch controller 100.

First, a process of correcting a skew of a sheet P is explained below with reference to FIGS. 25A and 25B. It is assumed that the sheet P is in such a condition that a corner of the sheet P is folded by the corner folding unit 3, and the corner-folded sheet P is accordion-folded by the accordion-folding unit 4.

Figure 26:
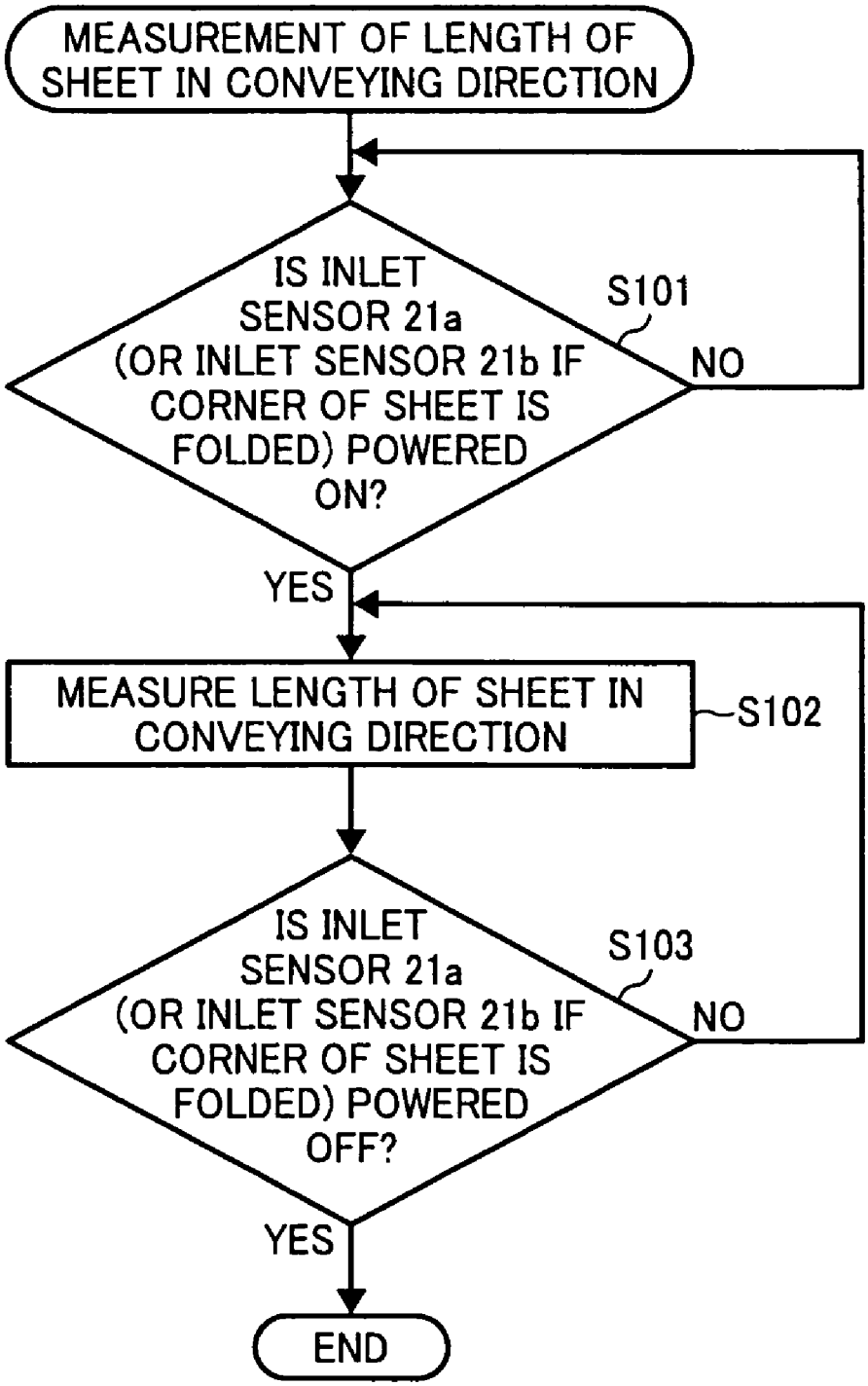
FIG. 26 is a flowchart of a process of measuring a length of a sheet in a conveying direction.

When the longitudinal conveying motor 30 shown in FIG. 17 is driven to rotate in the CCW direction (Step S1), the sheet P is conveyed in a direction of an arrow shown in FIG. 3, and further conveyed in a direction of an arrow shown in FIG. 12. The sheet P is conveyed along the guide plate 29 shown in FIG. 12, and dropped into the area between the jogger fences 22. At this time, to detect a length of the sheet P, it is determined whether a corner of the sheet P is folded (Step S2). A process of measuring a length of the sheet P in the conveying direction (see FIG. 26) is performed (Steps S3 and S4). As shown in the flowchart of FIG. 26, a leading edge of the sheet P is detected by the inlet sensor (for corner folding) 21*b* if the corner of the sheet P is folded, while on the other hand or the inlet sensor 21*a* if the corner of the sheet P is not folded. When the sheet P is conveyed from the accordion-folding unit 4, the inlet sensor 21*a* or 21*b* is powered ON (Step S101), and the conveying-direction switching punch controller 100 measures a length α of the sheet P in the conveying direction (Step S102). After that, the inlet sensor 21*a* or 21*b* is powered OFF (Step S103), and the process of measuring the length of the sheet P in the conveying direction is terminated.

After a predetermined time from a time point when the sheet P is dropped into the area between the jogger fences 22, the longitudinal conveying motor 30 is stopped (Step S5). Subsequently, the conveying-direction switching punch controller 100 measures a moving distance β of the jogger fences 22. If there is no need to adjust a punching position, the moving distance β is a difference between the stand-by position of the jogger-fence home-position light-shielding plate 22*e* where the jogger-fence home-position light-shielding plate 22*e* shields the jogger-fence home-position sensor 28 and a sum of a clearance A between the jogger fences 22 and the length α of the sheet P in the conveying direction (see FIG. 4) (Step S6).

Figure 29:
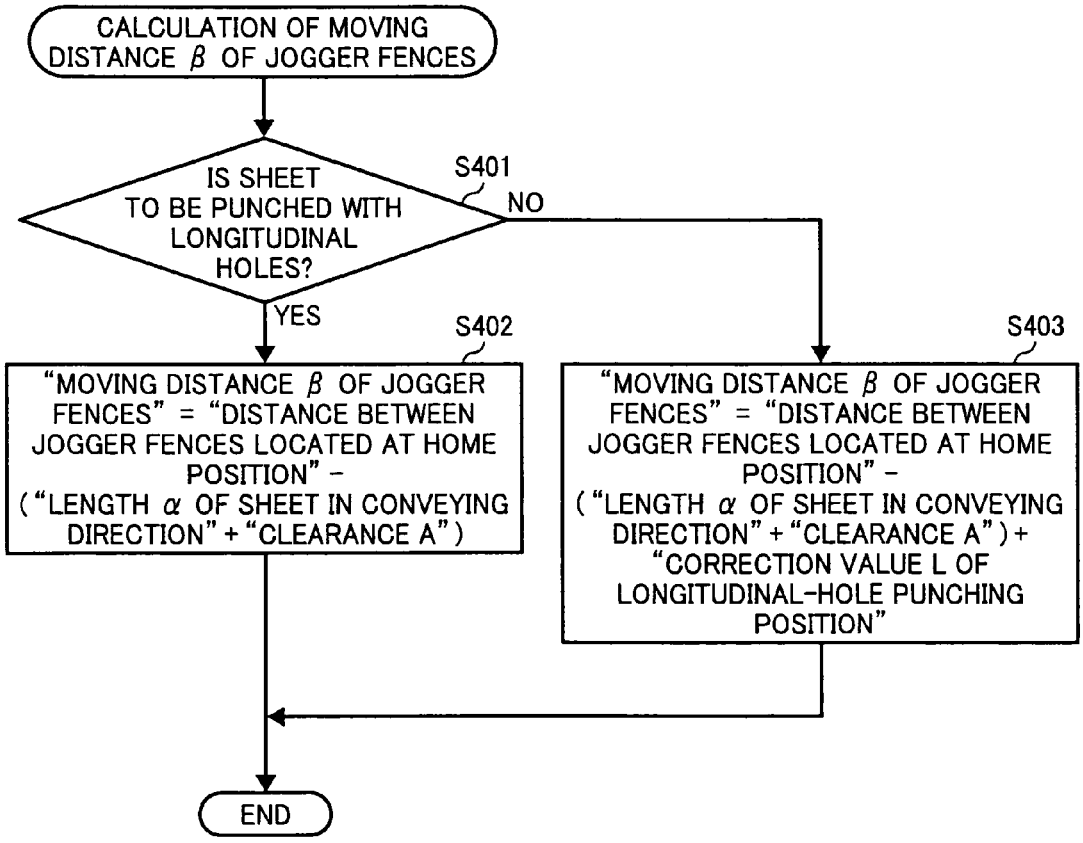
FIG. 29 is a flowchart of a process of calculating a moving distance of the jogger fences.

If the punching position needs to be adjusted, the moving distance β is a sum of the difference between the stand-by position of the jogger-fence home-position light-shielding plate 22*e* and the sum of the clearance A and the length α (see FIG. 4) and a correction value L of a longitudinal-hole punching position (see FIG. 12) (Step S6). FIG. 29 is a flowchart of a process of calculating the moving distance β of the jogger fences 22. When the sheet P is to be punched with a longitudinal hole (YES at Step S401), the moving distance β of the jogger fences 22 is obtained by a following Equation:

"the moving distance β of the jogger fences 22"="a distance between the jogger fences 22 in the jogger home position"−("the length α of the sheet P in the conveying direction"+"the clearance A") (Step S402)

When the sheet P is not to be punched with a longitudinal hole (NO at Step S401), the moving distance β of the jogger fences 22 is obtained by a following Equation:

"the moving distance β of the jogger fences 22"="a distance between the jogger fences 22 in the home position"−("the length α of the sheet P in the conveying direction"+"the clearance A")+"the correction value L of the longitudinal-hole punching position" (Step S403) Incidentally, the clearance A between the jogger fences 22 is a sum of a clearance between the jogger fence 22*a* on the upstream side and the sheet P and a clearance between the jogger fence 22*b* on the downstream side and the sheet P. According to the present embodiment, when the sheet P is conveyed along the guide plate 29 shown in FIG. 4, and dropped into the area between the jogger fences 22, the guide plate 29 is set up in such a way that the sheet P can be dropped near to the jogger fence 22*a* on the upstream side by controlling an angle or a height of the guide plate 29 based on a moving velocity of the sheet P discharged by the inlet conveying roller 20. In other words, the clearance between the jogger fence 22*a* on the upstream side and the sheet P is set up to be zero.

Subsequently, when the jogger motor 39 rotates in the CW direction (Step S7), the jogger fences 22 move at the moving distance β obtained at Step S6 (Step S8), and the jogger motor 39 stops rotating by leaving the clearance A shown in FIG. 4 (Step S9).

When the sheet P needs not to be folded by the cross-folding unit 6 on the downstream side (see FIG. 2), i.e., when the sheet P is any of a portrait A4-size sheet, a landscape A4-size sheet, and a portrait A3-size sheet in the present embodiment, the process control goes to Step S15. When the sheet P is to be folded by the cross-folding unit 6, the sheet P is struck on the jogger fences 22 by the return rollers 23 to correct a skew of the sheet P. According to the present embodiment, it is determined whether the sheet P shown in FIG. 3 is any of a portrait A4-size sheet, a landscape A4-size sheet, and a portrait A3-size sheet (Step S10).

If the sheet P shown in FIG. 3 is not any of a portrait A4-size sheet, a landscape A4-size sheet, and a portrait A3-size sheet (NO at Step S10), as shown in FIG. 19, the solenoid 49 is powered ON, the longitudinal-conveyance swinging lever 47 is pulled, the longitudinal conveying arm 26 rotates around the supporting point 26*a* from the position indicated by the dashed-two dotted line to the position indicated by the solid line, and the driven return roller 23*a* attached to the longitudinal conveying arm 26 via the pressure spring 46 has contact with the drive return roller 23*b* to apply a pressure to the drive return roller 23*b* (Step S11). At this time, as shown in FIG. 6, the press guide 25, which is rotatably attached to the axis 23*c* of the driven return roller 23*a*, presses a top surface of the sheet P. After a predetermined time, the longitudinal conveying motor 30 rotates in the CW direction opposite to the direction of the arrow shown in FIG. 17, the sheet P is conveyed to the jogger fence 22*a* on the upstream side by a rotation of the drive return roller 23*b* shown in FIG. 6 (Step S12).

After a predetermined time from a time point when the sheet P is struck on the jogger fence 22*a* on the upstream side as indicated by a dotted line shown in FIG. 6, the longitudinal conveying motor 30 stops rotating (Step S13). After that, the solenoid 49 is powered OFF (see FIG. 19), so that the driven return roller 23*a* rotates to move away from the drive return roller 23*b*, i.e., moves from the position indicated by the solid line to the position indicated by the dashed-two dotted line as the stand-by position (Step S14).

Then, the lateral-conveyance swinging pressure motor 57 rotates in the CCW direction shown in FIG. 20, and the lateral conveying driven rollers 24*a* move from the stand-by position indicated by the dashed-two dotted line to the position indicated by the solid line to have contact with the lateral conveying drive rollers 24*b* (Step S15).

Figure 8:
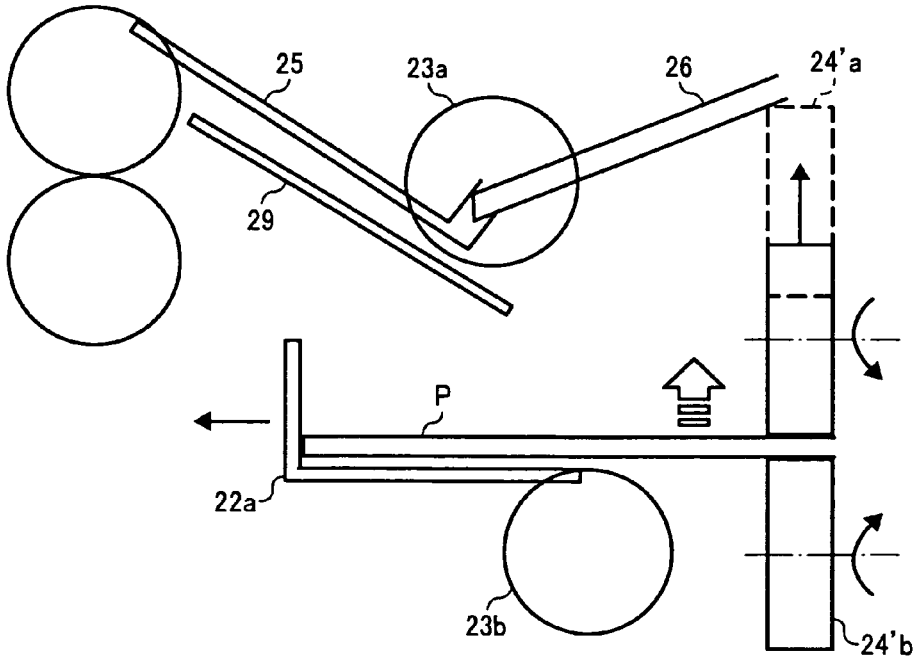
FIG. 8 is a side view of the sheet processing unit shown in FIG. 7.

After a predetermined time, when the sheet P is held between the lateral conveying driven rollers 24*a* and the lateral conveying drive rollers 24*b* as shown in FIG. 8, the lateral-conveyance swinging pressure motor 57 stops rotating (Step S16). When the lateral conveying motor 45 rotates in the CCW direction as indicated by an arrow shown in FIG. 18, the lateral conveying drive rollers 24*b* are driven to rotate in a direction of arrows, the lateral conveying driven rollers 24*a* and the lateral conveying drive rollers 24*b* respectively rotate in a direction of an arrow shown in FIG. 16 with holding the sheet P, and the sheet P is conveyed to the cross-folding unit 6 in a lateral direction as shown in FIG. 15 (Step S17). At this time, as shown in FIG. 9, when it is assumed that lateral conveying rollers located far from the return rollers 23 are referred to as the lateral conveying rollers 24, and lateral conveying rollers located near the return rollers 23 are referred to as lateral conveying rollers 24', a conveying force of the lateral conveying rollers 24' is larger than that of the lateral conveying rollers 24. This is because a bottom surface of the sheet P has contact with the drive return roller 23*b* when the sheet P is conveyed by the lateral conveying rollers 24 as shown in FIG. 8, so that a load is applied to the lateral conveying rollers 24. Therefore, by increasing the conveying force of the lateral conveying rollers 24', a balance between the conveying forces of the lateral conveying rollers 24 and the lateral conveying rollers 24' is equalized.

Figure 7:
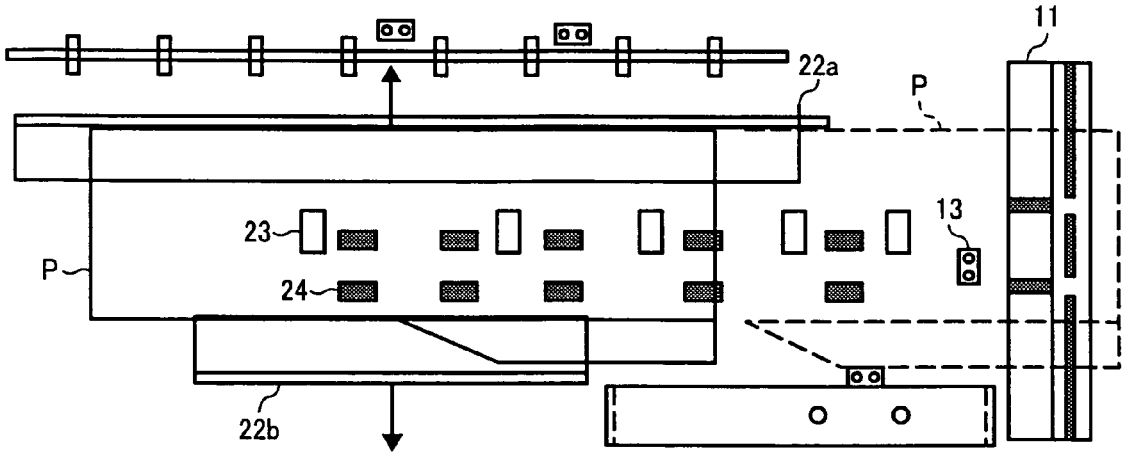
FIG. 7 is a plan view of the sheet processing unit for explaining a state in which a conveying direction of the A1-size portrait sheet is switched to correct the skew.

The sheet P is determined whether to be punched (Step S18). If the sheet P is to be punched (YES at Step S18), it is determined whether the sheet is to be punched with a longitudinal hole or a lateral hole (Step S19). If the sheet P is to be punched with a longitudinal hole, a process of conveying the sheet P to a longitudinal-hole punching position is performed (Step S20). If the sheet P is to be punched with a lateral hole, a process of conveying the sheet P to a lateral-hole punching position is performed (Step S21). If the sheet P is not to be punched (NO at Step S18), or after the process of conveying the sheet P to the longitudinal-hole punching position is performed (Step S20), the sheet P is conveyed to the cross-folding unit 6 in the lateral direction as shown in FIG. 7, and a leading edge of the sheet P passes through the sheet-leading-edge detecting sensor 13 as indicated by a dashed line (Step S22), and then a trailing edge of the sheet P passes through the sheet-leading-edge detecting sensor 13 (Step S23). When the trailing edge of the sheet P is detected by the sheet-leading-edge detecting sensor 13, the lateral conveying motor 45 shown in FIG. 18 stops rotating (Step S24). After that, a process of moving the jogger fences 22 back to the home position and a process of moving the lateral conveying driven rollers 24*a* back to the home position are performed (Step S25), and then the process of correcting a skew of the sheet P is terminated.

Figure 27:
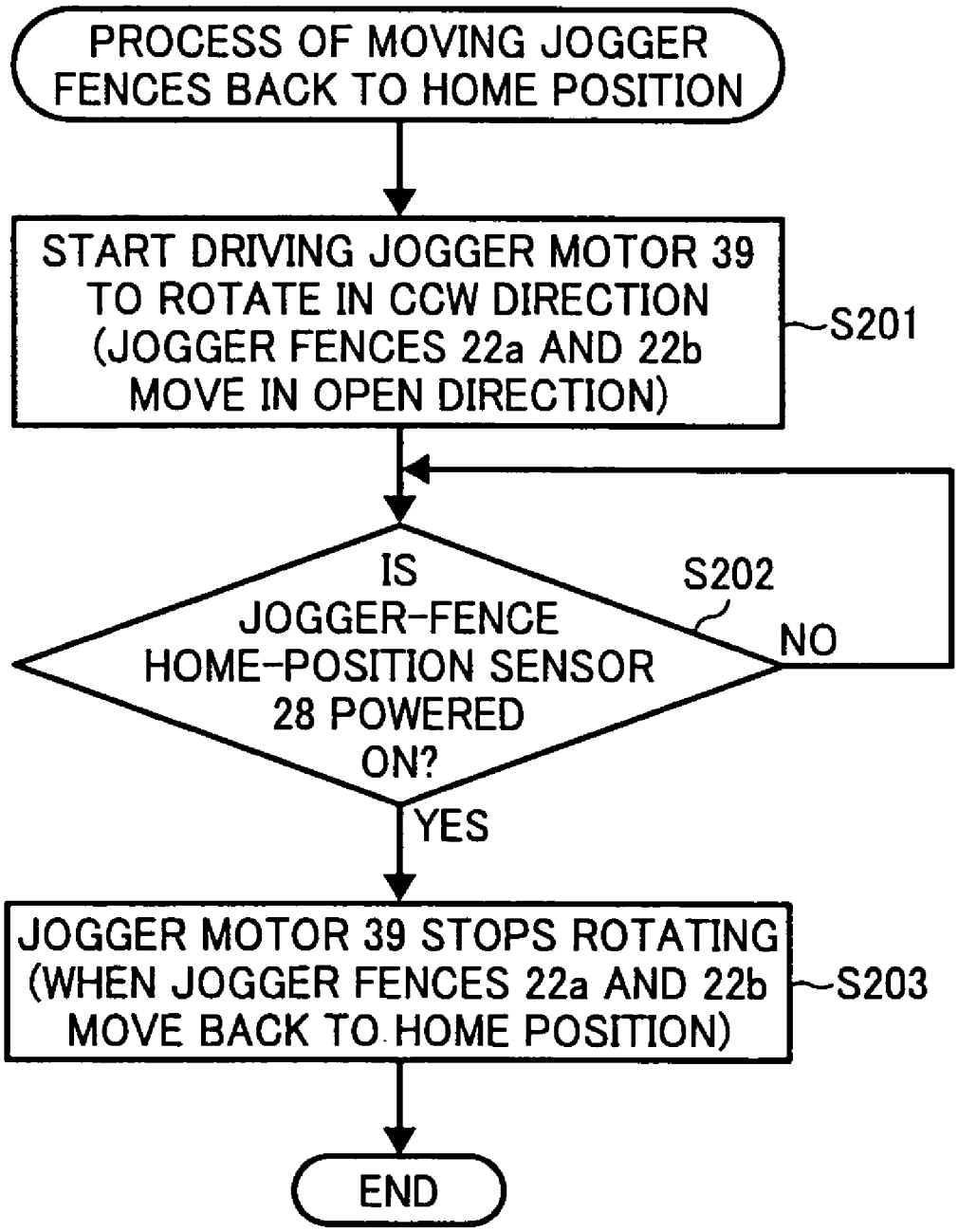
FIG. 27 is a flowchart of a process of moving jogger fences back to a home position.

FIG. 27 is a flowchart of the process of moving the jogger fences 22 back to the home position, i.e., a process of moving the jogger-fence home-position light-shielding plate 22*e* back to a position where the jogger-fence home-position light-shielding plate 22*e* shields the jogger-fence home-position sensor 28 so that the jogger-fence home-position sensor 28 can be turned ON.

Specifically, when the jogger motor 39 rotates in the CCW direction (see FIG. 17) (Step S201), the jogger fences 22*a* and 22*b* move in an open direction. When the jogger-fence home-position light-shielding plate 22*e* shields the jogger-fence home-position sensor 28, the jogger-fence home-position sensor 28 is powered ON (Step S202), and the jogger motor 39 stops rotating (Step S203). The process of moving the jogger fences 22 back to the home position is terminated.

Figure 28:
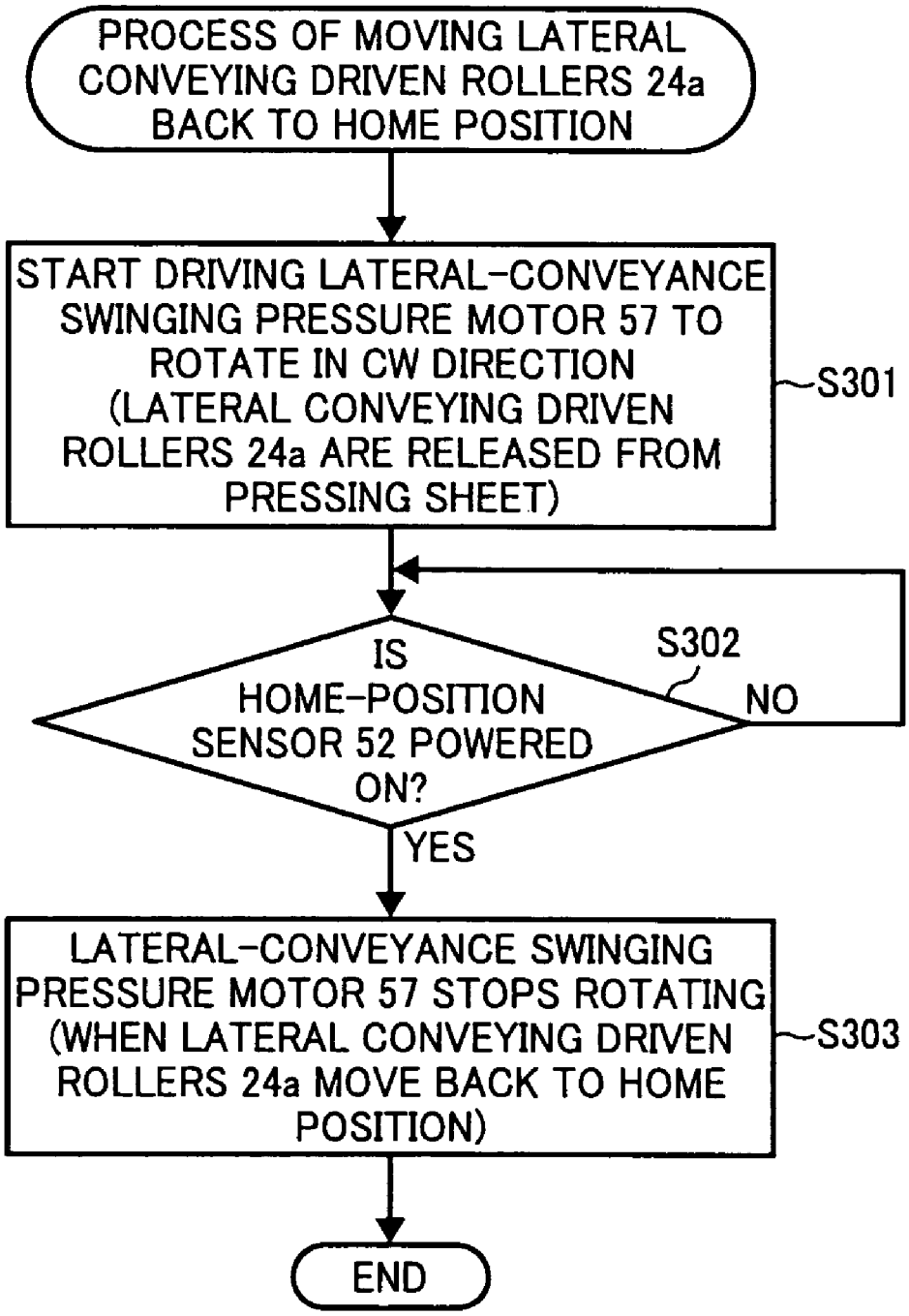
FIG. 28 is a flowchart of a process of moving lateral conveying driven rollers back to a home position.

FIG. 28 is a flowchart of the process of moving the lateral conveying driven rollers 24*a* back to the home position. When the lateral-conveyance swinging pressure motor 57 rotates in the CW direction (Step S301), the lateral conveying driven rollers 24*a* moves away from the lateral conveying drive rollers 24*b*, i.e., moves from the position indicated by the solid line to the stand-by position indicated by the dashed-two dotted line (Step S301). When the home-position detecting light-shielding plate 50*c* shields the home-position sensor 52, the home-position sensor 52 is powered ON (Step S302), and detects the home position of the lateral conveying driven rollers 24*a*. After that, the lateral-conveyance swinging pressure motor 57 stops rotating (Step S303), and the process of moving the lateral conveying driven rollers 24*a* back to the home position is terminated.

Figure 30:
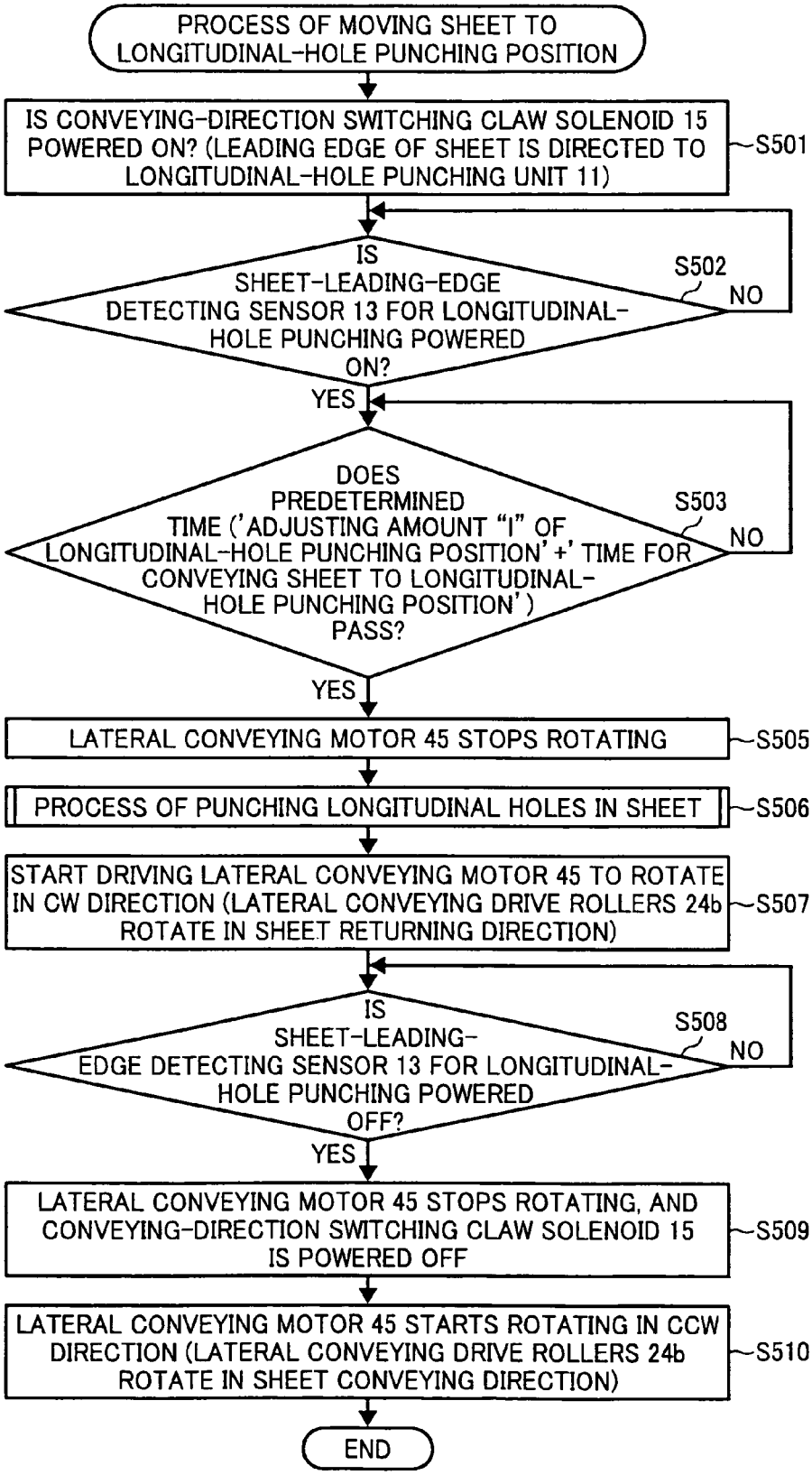
FIG. 30 is a flowchart of a process of moving a sheet to a longitudinal-hole punching position.

The process of moving the sheet P to the longitudinal-hole punching position at Step S20 is explained in detail below with reference to a flowchart shown in FIG. 30. When the conveying-direction switching claw solenoid 15 shown in FIG. 9 is powered ON, as shown in FIG. 10, a switching claw 14 for switching the conveying direction of the sheet P to be punched moves from a position indicated by a dashed line to a position indicated by a solid line, so that the sheet P is conveyed on a sheet conveying path to the longitudinal-hole punching unit 11 (Step S501). When the leading edge of the sheet P passes through the sheet-leading-edge detecting sensor 13 as shown in FIG. 17, the sheet-leading-edge detecting sensor 13 detects the leading edge of the sheet P (Step S502). After a predetermined time (Step S503), the lateral conveying motor 45 shown in FIG. 18 stops rotating (Step S505). In this case, the predetermined time indicates an amount in which an adjusting amount I of the longitudinal-hole punching position is added to a time for conveying the sheet P to the longitudinal-hole punching position. When the adjusting amount I is zero, the leading edge of the sheet P is struck on a struck surface 11*b* for longitudinal-hole punching. Then, the sheet P is punched with a longitudinal hole (Step S506).

Subsequently, when the lateral conveying motor 45 rotates in the CW direction opposite to the direction shown in FIG. 18, the lateral conveying drive rollers 24*b* are driven to rotate in the reverse direction, and the sheet P is conveyed in a direction of a dashed arrow shown in FIG. 10 in a switchback manner (Step S507). When the leading edge of the sheet P passes through the sheet-leading-edge detecting sensor 13 (Step S508), the lateral conveying motor 45 stops rotating, and the conveying-direction switching claw solenoid 15 shown in FIG. 9 is powered OFF, and then the switchback conveyance of the sheet P is stopped (Step S509). When the lateral conveying motor 45 starts rotating in the CCW direction as shown in FIG. 18, the lateral conveying drive rollers 24*b* are driven to rotate in the direction of the arrows, and the lateral conveying driven rollers 24*a* rotate in the direction of the arrow with holding the sheet P between the lateral conveying driven rollers 24*a* and the lateral conveying drive rollers 24*b* as shown in FIG. 16. Therefore, the sheet P is conveyed to the cross-folding unit 6 in the lateral direction as shown in FIG. 15 (Step S510), the process of conveying the sheet P to the longitudinal-hole punching position is terminated.

The process of conveying the sheet P to the lateral-hole punching position at Step S21 is explained in detail with reference to a flowchart shown in FIG. 31. When the sheet P is conveyed in the lateral direction as shown in FIG. 11, and the leading edge of the sheet P passes through the sheet-leading-edge detecting sensor 13, the leading edge of the sheet P is detected by the sheet-leading-edge detecting sensor 13 (Step S601). After a predetermined time (Step S602), the lateral conveying motor 45 shown in FIG. 18 stops rotating (Step S603). In this case, the predetermined time indicates an amount in which an adjusting amount L of the lateral-hole punching position shown in FIG. 12 is added to a time for conveying the sheet P to the lateral-hole punching position. To switch the sheet conveying direction from the lateral conveyance to the longitudinal conveyance, the process of moving the lateral conveying driven rollers 24*a* back to the home position is performed (Step S604).

As shown in FIG. 12, when the jogger-fence swinging solenoid 27 is powered ON, the jogger fence 22*b* rotates around the rotating center 22*c* to move from a position indicated by a dashed line to a position indicated by a solid line (Step S605). When the solenoid 49 shown in FIG. 19 is powered ON, the driven return roller 23*a* rotates from the position indicated by the dashed-two dotted line to the position indicated by the solid line, and the driven return roller 23*a* has contact with the drive return roller 23*b* as shown in FIG. 12 (Step S606). After a predetermined time, the longitudinal conveying motor 30 rotates in the CCW direction as shown in FIG. 17, and the drive return roller 23*b* rotates in a direction of a solid arrow shown in FIG. 13, so that the sheet P is conveyed in a direction of a solid arrow (Step S607). When the leading edge of the sheet P passes through the sheet-leading-edge detecting sensor 12 (Step S608), the longitudinal conveying motor 30 shown in FIG. 17 stops rotating (Step S609). In this case, the predetermined time indicates an amount in which the adjusting amount I of the lateral-hole punching position shown in FIG. 12 is added to a time for conveying the sheet P to the lateral-hole punching position.

When the adjusting amount I is zero, the leading edge of the sheet P is struck on a struck surface 10*b* for lateral-hole punching.

As shown in FIG. 12, the lateral-hole punching unit 10 has a width W so that a portion of a length of a binding margin h of the sheet P shown in FIG. 14 can be inserted into the lateral-hole punching unit 10 as the sheet P indicated by a dashed line shown in FIG. 12. The return rollers 23 are arranged to be opposed to the punching position (the hole position) of the lateral-hole punching unit 10 shown in FIG. 12. In such a state, the lateral-hole punching unit 10 punches a lateral hole in the sheet P (Step S610). After that, when the longitudinal conveying motor 30 rotates in the CW direction opposite to the direction of the arrow shown in FIG. 17, the drive return roller 23*b* rotates in a direction of a dashed arrow shown in FIG. 13, so that the sheet P is conveyed in a switch-back manner to the jogger fence 22*a* on the upstream side in a direction of a dashed arrow (Step S611). After a predetermined time, the sheet P is struck on the jogger fence 22*a* on the upstream side, and the longitudinal conveying motor 30 stops rotating (Step S612).

When the solenoid 49 shown in FIG. 19 is powered OFF, the driven return roller 23*a* rotates from the position indicated by the solid line to the position indicated by the dashed-two dotted line as the stand-by position (Step S613). When the jogger-fence swinging solenoid 27 is powered OFF, the jogger fence 22*b* rotates around the rotating center 22*c* to move from the position indicated by the solid line to the position indicated by the dashed line (Step S614). After that, when the lateral-conveyance swinging pressure motor 57 rotates in the CCW direction shown in FIG. 20, the lateral conveying driven rollers 24*a* move away from the lateral conveying drive rollers 24*b*, i.e., move from the position indicated by the dashed-two dotted line as the stand-by position to the position indicated by the solid line (Step S615). After a predetermined time, the lateral conveying driven rollers 24*a* move to the position indicated by the dashed-two dotted line as shown in FIG. 13, and the sheet P is held between the lateral conveying driven rollers 24*a* and the lateral conveying drive rollers 24*b*, and then the lateral-conveyance swinging pressure motor 57 stops rotating (Step S616).

When the lateral conveying motor 45 shown in FIG. 18 rotates again in the CCW direction, the sheet P is conveyed to the cross-folding unit 6 in the direction of the arrow shown in FIG. 12 (Step S617). The leading edge of the sheet P is detected by the sheet-leading-edge detecting sensor 13 (Step S618), and the trailing edge of the sheet P passes through the sheet-leading-edge detecting sensor 13 (Step S619). The lateral conveying motor 45 shown in FIG. 18 stops rotating (Step S620). After that, the process of moving the jogger fences 22 back to the home position and the process of moving the lateral conveying driven rollers 24*a* back to the home position are performed (Step S621), and then the process of conveying the sheet P to the lateral-hole punching position is terminated.

Figure 32:
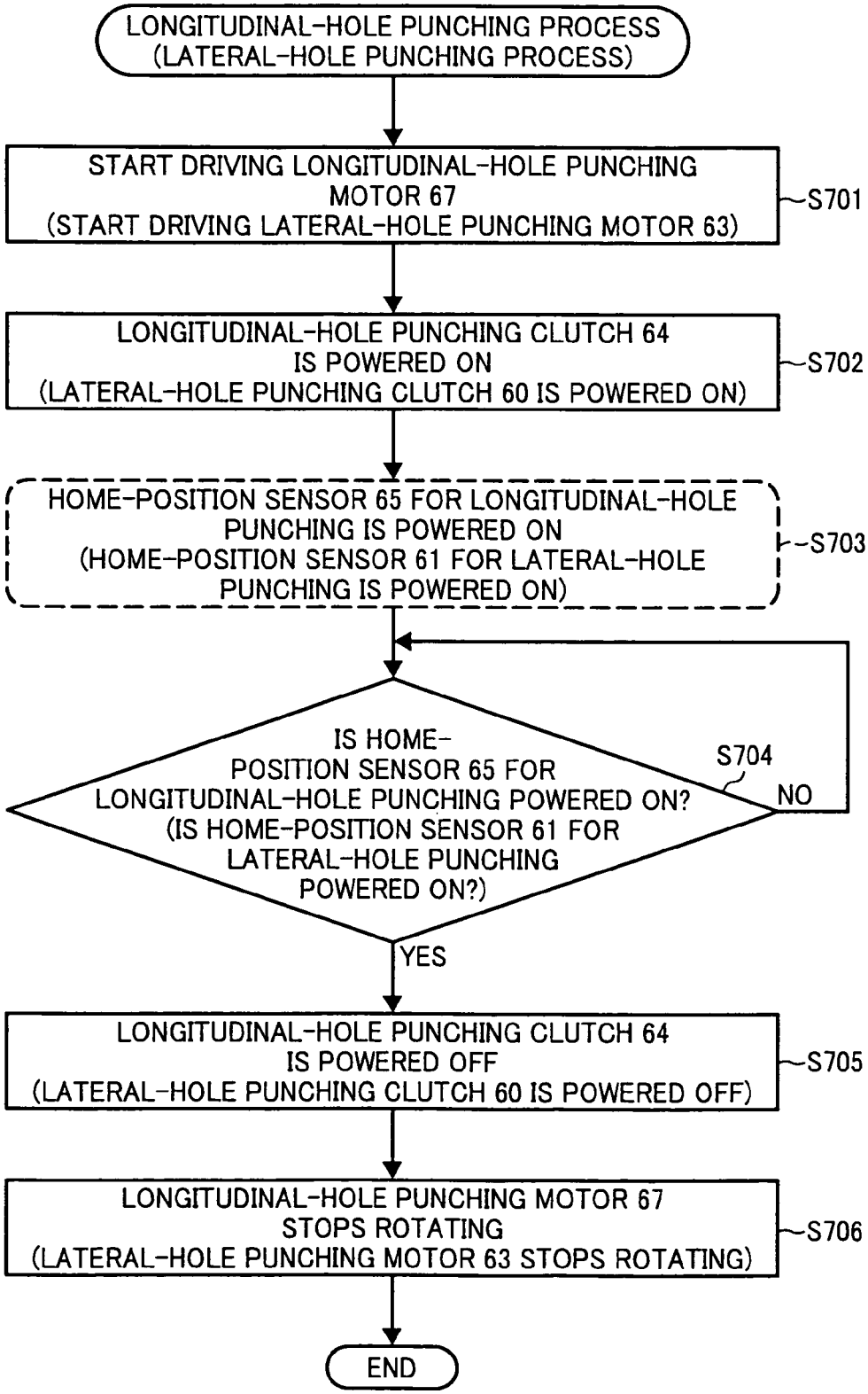
FIG. 32 is a flowchart of a process of punching a longitudinal hole (or a lateral hole) in a sheet.

Subsequently, the process of punching a longitudinal hole in the sheet P at Step S506 and the process of punching a lateral hole in the sheet P at Step S610 are explained in detail below with reference to a flowchart shown in FIG. 32. Basically, the longitudinal-hole punching unit 11 and the lateral-hole punching unit 10 have the same configuration, so that the longitudinal-hole punching unit 11 is explained below, and the description of the process of punching a lateral hole in the sheet P performed by the lateral-hole punching unit 10 is omitted.

The lateral-hole punching motor 63 shown in FIG. 21 rotates in a specified direction (Step S701). The longitudinal-hole punching clutch 64 is powered ON (Step S702). At this time, it is determined whether the home-position sensor 65 is powered ON and in a stand-by mode. When the home-position sensor 65 is powered ON and in the stand-by mode, a rotation transmission from the longitudinal-hole punching motor 67 is passed to the drive shaft 11*a* via the longitudinal-hole punching clutch 64, and the sheet P is punched by a punch moving mechanism (not shown). The home-position sensor 65 is powered OFF, and again powered ON to be in the stand-by mode after the sheet P is punched (Step S704). At this time, the longitudinal-hole punching clutch 64 is powered OFF (Step S705). After a predetermined time, the longitudinal-hole punching motor 67 stops rotating (Step S706), and then the process of punching a longitudinal hole in the sheet P is terminated.

In the present embodiment, the sheet folding device 1 is connected to the rear side of the main body 200 of the copying machine as an image forming apparatus. Alternatively, the main body 200 can include therein a sheet processing unit (a sheet folding device), which folds a sheet a plurality of times and conveys the folded sheet, and a cross-folding unit (a cross-folding device), which cross-folds the folded sheet on a vertically-extending conveying path connected to a sheet conveying path on which the folded sheet is conveyed to the cross-folding unit.

In this manner, in the sheet folding device according to the present embodiment, after a sheet is punched, the punched sheet is cross-folded on a vertically-extending conveying path. Therefore, it is possible to save space for installing the sheet folding device.

Furthermore, a sheet reversing unit is arranged above a cross-folding roller (in the downstream side of a sheet conveying direction) on the vertically-extending conveying path. Therefore, it is possible to save space for installing the sheet folding device.

Moreover, the sheet reversing unit reverses a sheet by conveying back the sheet in an inward direction of the device and conveying the sheet back in an outward direction of the device, so that the sheet can be reversed inside the sheet processing device 1. Therefore, it is possible to save space for installing the sheet folding device.

Furthermore, an outlet of the sheet conveying path is not only used to convey the sheet in the inward direction of the device but also used by the sheet reversing unit, and serves as a sheet discharging opening. Therefore, it is possible to save space for installing the sheet folding device.

Moreover, a sheet guide is provided outside the outlet of the sheet conveying path. Therefore, only accordion-folded sheets output from an accordion-folding unit (or the cross-folding unit) can be stocked.

Furthermore, a size of the sheet guide is adjustable depending on a size of the sheet. Therefore, even when the accordion-folded sheets differ in size, the accordion-folded sheets can be stocked.

Moreover, when a jam of the sheet occurs, an upper conveyance guide plate included in the sheet reversing unit is opened in the inward direction of the device to fix the jam. Therefore, it is possible to save space for installing the sheet folding device.

Furthermore, a switching unit for reversing a sheet is provided at an inlet of the sheet reversing unit. Therefore, the inlet can be used as a discharging opening of the sheet, and thus it is possible to save space for installing the sheet folding device.

Moreover, the reverse switching unit includes two different switching claws that respectively change a direction of rotation depending on a switch signal. Therefore, it is possible to operate the switching claws separately, and thus it is possible to improve a working efficiency at a time to fix a jam.

Furthermore, the switching unit of the sheet reversing unit is composed of two different guide plates that respectively change a direction of rotation depending on a switch signal. Therefore, it is possible to improve an assembling operability. Moreover, it is possible to operate the guide plates separately, and thus it is possible to improve working efficiency at a time to fix a jam.

Furthermore, a sheet rotating unit is provided above the cross-folding unit and the sheet reversing unit. Therefore, it is possible to save space for installing the sheet folding device.

Moreover, centers of an x-axis and a y-axis of a sheet are pressed by a shaft of the sheet rotating unit, and any one side of a conveying roller is driven to rotate to convey the sheet, and the other side of a conveying roller is released from pressing the sheet. Therefore, it is possible to change a conveying direction of the sheet with saving space.

Furthermore, centers of an x-axis and a y-axis of the a are pressed by a tip of a movable shaft of the sheet rotating unit, and any one side of a conveying roller is driven to rotate in a CCW direction, and the other side of a conveying roller is driven to rotate in a CW direction to convey the sheet. Therefore, it is possible to change the conveying direction of the sheet with saving space.

Moreover, a conveyance guide plate of the sheet rotating unit is configured to be openable in an inward direction of the sheet processing device to fix a jam. Therefore, it is possible to save working space for fixing the jam.

Furthermore, a sheet discharging unit is provided above the sheet rotating unit. Therefore, it is possible to save space for installing the sheet folding device.

Moreover, the sheet discharging unit is a sheet tray on which a post-processed sheet is stacked. Therefore, it is possible to save space for installing the sheet folding device including a post-processing device.

Furthermore, the sheet tray vertically move downward depending on the number of sheets stacked on the sheet tray. Therefore, it is possible to increase stacking space, and thus it is possible to stack a large quantity of sheets on the sheet tray.

Moreover, the sheet discharging unit arranged above the sheet rotating unit is included in a main body of the sheet folding device. Namely, the sheet tray does not extend outside the post-processing device. Therefore, it is possible to promote a space saving of the sheet folding device.

Furthermore, when a sheet jam occurs in any of the cross-folding unit, the sheet reversing unit, the sheet rotating unit and the sheet tray, a location where the sheet jam occurs is displayed on a display unit of the image forming apparatus. Therefore, a user can recognize the location, so that it is possible to improve the operability.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A sheet processing device that folds a sheet a plurality of times and outputs a folded sheet, the sheet processing device comprising:

a cross folding unit that cross-folds the folded sheet that is folded a plurality of times at preceding stages;

a reversing unit that reverses the folded sheet in a downstream side of the cross folding unit in a sheet conveying direction on the second sheet conveying path; and a sheet guide for guiding the folded sheet, which is arranged outside the outlet, wherein the cross folding unit cross-folds the folded sheet on a second sheet conveying path that is perpendicular to a first conveying path for processes of precedent stages, the reversing unit reverses the folded sheet by conveying the folded sheet in an inward direction of a main body of the sheet processing device and conveying the sheet back in an outward direction of the main body, and an outlet is provided on a sheet conveying path for conveying the folded sheet in the inward direction of the main body.

2. The sheet processing device according to claim 1, wherein a size of the sheet guide is adjustable to a size of the sheet.

3. The sheet processing device according to claim 1, wherein the reversing unit includes an upper conveyance guide plate, and when a sheet jam occurs, the upper conveyance guide plate is opened in the inward direction to fix the sheet jam.

4. The sheet processing device according to claim 1, further comprising a reverse switching unit for switching a reverse operation, which is provided at an inlet of the reversing unit.

5. The sheet processing device according to claim 4, wherein the reverse switching unit includes at least one guide member that rotates in different directions depending on a switch signal.

6. The sheet processing device according to claim 1, further comprising a punching unit that punches a hole in a predetermined portion of the folded sheet.

7. The sheet processing device according to claim 1, further comprising a sheet rotating unit that rotates the folded sheet, which is provided in a downstream side of the reversing unit in the sheet conveying direction.

8. The sheet processing device according to claim 7, wherein centers of x-axis and y-axis of the folded sheet are pressed by a shaft of the sheet rotating unit, the sheet rotating unit includes a first conveying roller and a second conveying roller, and either one of the first conveying roller and the second conveying roller is driven to rotate to convey the sheet.

9. The sheet processing device according to claim 7, wherein centers of x-axis and y-axis of the folded sheet are pressed by a tip of a shaft of the sheet rotating unit, the shaft being capable of moving away from the second conveying path, the sheet rotating unit includes a first conveying roller and a second conveying roller, and one of the first conveying roller and the second conveying roller is driven to rotate in a counterclockwise direction, and other of the first conveying roller and the second conveying roller is driven to rotate in a clockwise direction to convey the sheet.

10. The sheet processing device according to claim 7, wherein the sheet rotating unit includes an openable conveyance guide plate, and when a sheet jam occurs, the conveyance guide plate is opened in an inward direction of a main body of the sheet processing device to fix the sheet jam.

11. The sheet processing device according to claim 7, wherein the sheet rotating unit includes a sheet discharging unit for discharging the folded sheet, which is arranged in a downstream side of the sheet rotating unit in the sheet conveying direction.

12. The sheet processing device according to claim 11, wherein the sheet discharging unit is formed with a sheet discharging tray.

13. The sheet processing device according to claim 12, wherein the sheet discharging unit is provided in the downstream side of the reversing unit in the sheet conveying direction.

14. The sheet processing device according to claim 11, wherein the sheet discharging unit is formed with a sheet discharging tray, and the sheet discharging unit is moved in a vertical direction according to number of discharged sheets.

15. An image forming apparatus comprising:

a sheet processing device that folds a sheet a plurality of times and outputs a folded sheet, wherein the sheet processing device includes, a cross folding unit that cross-folds the folded sheet that is folded a plurality of times at preceding stages, a reversing unit that reverses the folded sheet in a downstream side of the cross folding unit in a sheet conveying direction on the second sheet conveying path, and a sheet guide for guiding the folded sheet, which is arranged outside the outlet, the cross folding unit cross-folds the folded sheet on a second sheet conveying path that is perpendicular to a first conveying path for processes of precedent stages the reversing unit reverses the folded sheet by conveying the folded sheet in an inward direction of a main body of the sheet processing device and conveying the sheet back in an outward direction of the main body, and an outlet is provided on a sheet conveying path for conveying the folded sheet in the inward direction of the main body.

16. The image forming apparatus according to claim 15, further comprising a main-body display unit that for displaying, when a sheet jam occurs, a location of the sheet jam.

* * * * *